US005413052A

United States Patent [19]

Breezer et al.

[11] Patent Number: 5,413,052

[45] **Date of Patent: * May 9, 1995**

[54] PLASTIC PALLET WITH TWO DECKS

[75] Inventors: Harlon W. Breezer, Portage, Wis.; Kenneth C. Wilken, Minneapolis, Minn.; Michael J. Wolfe, Pardeeville; William Price, Portage, both of Wis.

[73] Assignee: TriEnda Corporation, Portage, Wis.

[ * ] Notice: The portion of the term of this patent subsequent to Mar. 30, 2010 has been disclaimed.

[21] Appl. No.: 39,723

[22] Filed: Mar. 29, 1993

Related U.S. Application Data

[63] Continuation-in-part of Ser. No. 740,374, Aug. 5, 1991, Pat. No. 5,197,396.

[51] Int. Cl.[6] ..... B65D 19/12

[52] U.S. Cl. ..... 108/56.1; 108/51.1

[58] Field of Search ..... 108/51.1, 56.3, 56.1, 108/901

[56] References Cited

U.S. PATENT DOCUMENTS

| | | |
|---|---|---|
| 2,930,560 | 3/1960 | Carnwath et al. . |
| 2,973,931 | 3/1961 | Brown . |
| 3,123,020 | 3/1964 | Voissem . |
| 3,277,847 | 10/1966 | Jensen . |
| 3,407,758 | 10/1968 | Simkins . |
| 3,610,173 | 10/1971 | McIlwraith . |
| 3,667,403 | 6/1972 | Angelbeck, Jr. . |
| 3,683,823 | 8/1972 | Schmid . |
| 3,691,964 | 10/1972 | Larson et al. . |
| 3,696,761 | 10/1972 | Brown . |
| 3,699,901 | 10/1972 | Cook, III . |
| 3,824,933 | 7/1974 | Lind . |
| 3,832,955 | 9/1974 | Pottinger et al. . |
| 3,835,792 | 9/1974 | Wharton . |
| 4,128,253 | 12/1978 | Powers . |
| 4,228,744 | 10/1980 | Moore . |
| 4,267,781 | 5/1981 | Powers . |
| 4,292,900 | 10/1981 | Bula . |
| 4,397,247 | 8/1983 | Lemelson . |
| 4,597,338 | 7/1986 | Kreeger . |
| 4,735,154 | 4/1988 | Hemery . |
| 4,843,976 | 7/1989 | Pigott et al. . |
| 5,255,613 | 10/1993 | Shuert ..... 108/901 |

*Primary Examiner*—Peter R. Brown
*Assistant Examiner*—Gerald A. Anderson
*Attorney, Agent, or Firm*—Lathrop & Clark

[57] ABSTRACT

A plastic pallet has a twin sheet thermoformed upper deck reinforced with a tubular metal substrate. Injection molded plastic octagonal posts have support member walls which are positioned beneath reinforced portions of the top deck. The posts also have a sleeve with a central bolt hole which is parallel to the support member walls. A twin sheet thermoformed lower deck is spaced from the upper deck by the posts and receives the posts in recessed pockets. Plastic bolts are inserted through the top deck, each post, and the bottom deck and are held in place by plastic T-nuts. A sawtooth parting line in the twin-sheet thermoforming molds provide accurate alignment and molding of the pallet parts.

8 Claims, 20 Drawing Sheets

PLASTIC PALLET WITH TWO DECKS

This application is a continuation-in-part of application Ser. No. 07/740,374, filed Aug. 5, 1991, now U.S. Pat. No. 5,197,396.

FIELD OF THE INVENTION

The present invention relates to pallets in general and to pallets having connected upper and lower decks in particular.

BACKGROUND OF THE INVENTION

Pallets are used in the manufacture, transportation and storage of a wide variety of products. A palletized load may be conveniently packed by the manufacturer, transported, stored in stacks or racked, and delivered to the end user conveniently and efficiently. Although wooden pallets are widely used, wooden pallet quality is variable due to variations in wood and assembly techniques. Furthermore, exposed nails and wood splinters as well as the inherent difficulties in maintaining wood surfaces in a sanitary condition make wooden pallets undesirable in industries such as the food and canned goods industries, where high levels sanitation are required.

Plastic pallets have been employed to overcome some of these drawbacks of wooden pallets. In particular, pallets have been formed by a process of twin sheet thermoforming which are durable and easily cleaned.

In an effort to extend the usable lifetime of a pallet, pallets are known which utilize two decks joined by replaceable legs or posts. The pallet legs, which come into repeated contact with the sharp metal tines of forklift vehicles, are subjected to the most intense wear of any part on the pallet. In these pallets, a damaged leg may be removed from the double deck assembly and replaced with a fresh leg at a cost far less than replacing the entire pallet.

Known replaceable legs generally are cylindrical, and bolted between upper and lower decks, or have employed various barbed geometries to allow a snap-fit connection between upper and lower decks.

Due to the inherent material properties of plastic and the desire for an overall light-weight pallet, in applications requiring the support of heavy loads the plastic upper deck of the pallet has been reinforced with metal rods or tubular metal substrates.

Reinforced double deck pallets are known which utilize snap fit posts. Snap fit posts, however, are subject to failure when placed in tension and also require specialized tools to remove.

What is needed is a double deck reinforced plastic pallet of high load-carrying capacity which may be economically formed and maintained in a sanitary condition and which has leg posts which are durable and which are easily replaced.

SUMMARY OF THE INVENTION

A double deck plastic pallet has a twin-sheet thermoformed top deck with a planar load bearing surface with peripheral edges. A reinforcing metal substrate is located within the top deck. A twin-sheet thermoformed bottom deck is spaced beneath the top deck and a plurality of plastic posts extend between the top deck and the bottom deck. Each post has a vertically extending support member which is engaged against the lower plastic sheet beneath the metal substrate of the top deck in load bearing relation. Each post also has a sleeve portion which is integrally formed with the support member. The post sleeve portions are horizontally spaced from the substrate. The twin-sheet thermoformed top and bottom decks are of closed cell construction and the posts are engaged within pockets in the bottom deck which seal the posts against entry of liquids.

It is an object of the present invention to provide a double deck plastic pallet with a metal reinforced top deck which effectively transmits the loads carded by the reinforcing structure to pallet support posts.

It is also an object of the present invention to provide a double deck plastic pallet with easily attachable support posts.

It is another object of the present invention to provide a double deck plastic pallet with twin sheet thermoformed upper and lower decks.

It is a further object of the present invention to provide a double deck pallet which is sealed against the entry of liquids into the interior of the pallet.

It is yet another object of the present invention to provide a double deck plastic pallet with four-way entry for the tines of a lift vehicle which may be stored in stacks or edge-racked.

It is a still further object of the present invention to provide a double deck pallet with posts which may be quickly and effectively replaced when damaged.

It is an additional object of the present invention to provide a pallet with a reinforcing substrate which is resistant to the puncturing of the plastic pallet skin.

It is still another object of the present invention to provide a pallet which may economically be manufactured with greater or lesser load-beating capacity by adding or omitting reinforcing substrates.

It is yet further an object of the present invention to provide a pallet deck the structure of which facilitates accurate thermoforming.

Further objects, features and advantages of the present invention will become apparent from the following specification when taken in conjunction with the following drawings.

DESCRIPTION OF THE PREFERRED EMBODIMENTS

Figure 1:
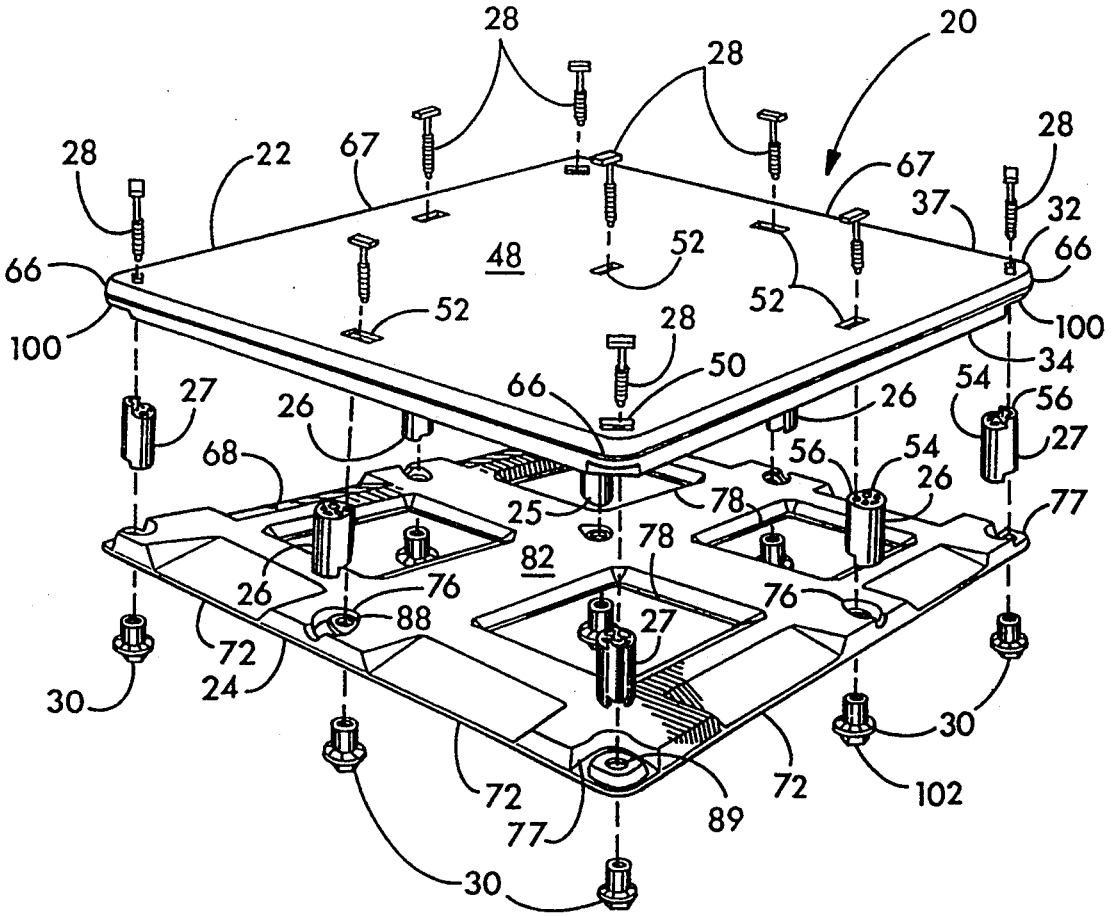
FIG. 1 is an exploded perspective view of the double deck plastic pallet of this invention.
Figure 2:
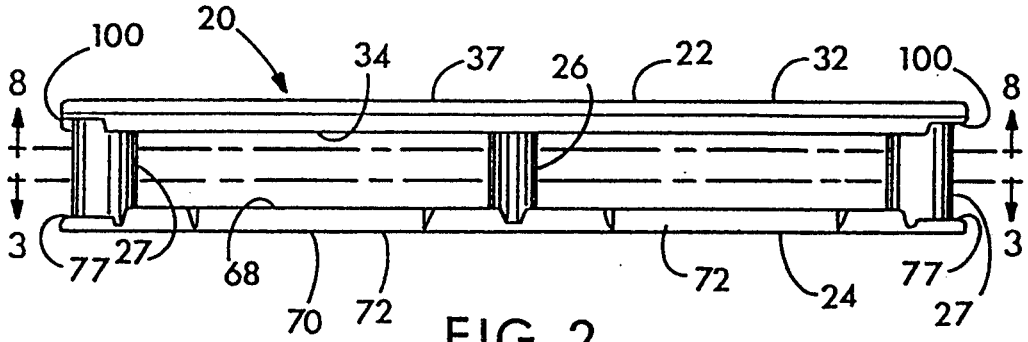
FIG. 2 is a side elevational view of the assembled pallet of FIG. 1.

Referring more particularly to FIGS. 1–46, wherein like numbers refer to similar parts, a double deck plastic pallet 20 is shown in FIG. 1–14, with the component parts of the pallet 20 illustrated in FIG. 1. The pallet 20 is comprised of a twin-sheet thermoformed top deck 22 which is spaced from a twin-sheet thermoformed bottom deck 24 by a plurality of extruded plastic posts 25, 26, 27. The decks and posts are secured together by a plurality of T-bolts 28 and nuts 30.

The top deck 22 and the bottom deck 24 of the pallet 20 are manufactured by a twin-sheet thermoforming process. Each deck 22, 24 is thus formed from two heated sheets of thermoplastic resin material which are vacuum formed and fused together to form a unitary plastic structure. The thermoplastic sheets may be of virgin high density polyethylene. The structure of the pallet 20 is designed, however, to advantageously utilize recycled polyethylene materials, such as may be derived from recycled milk bottles.

Figure 6:
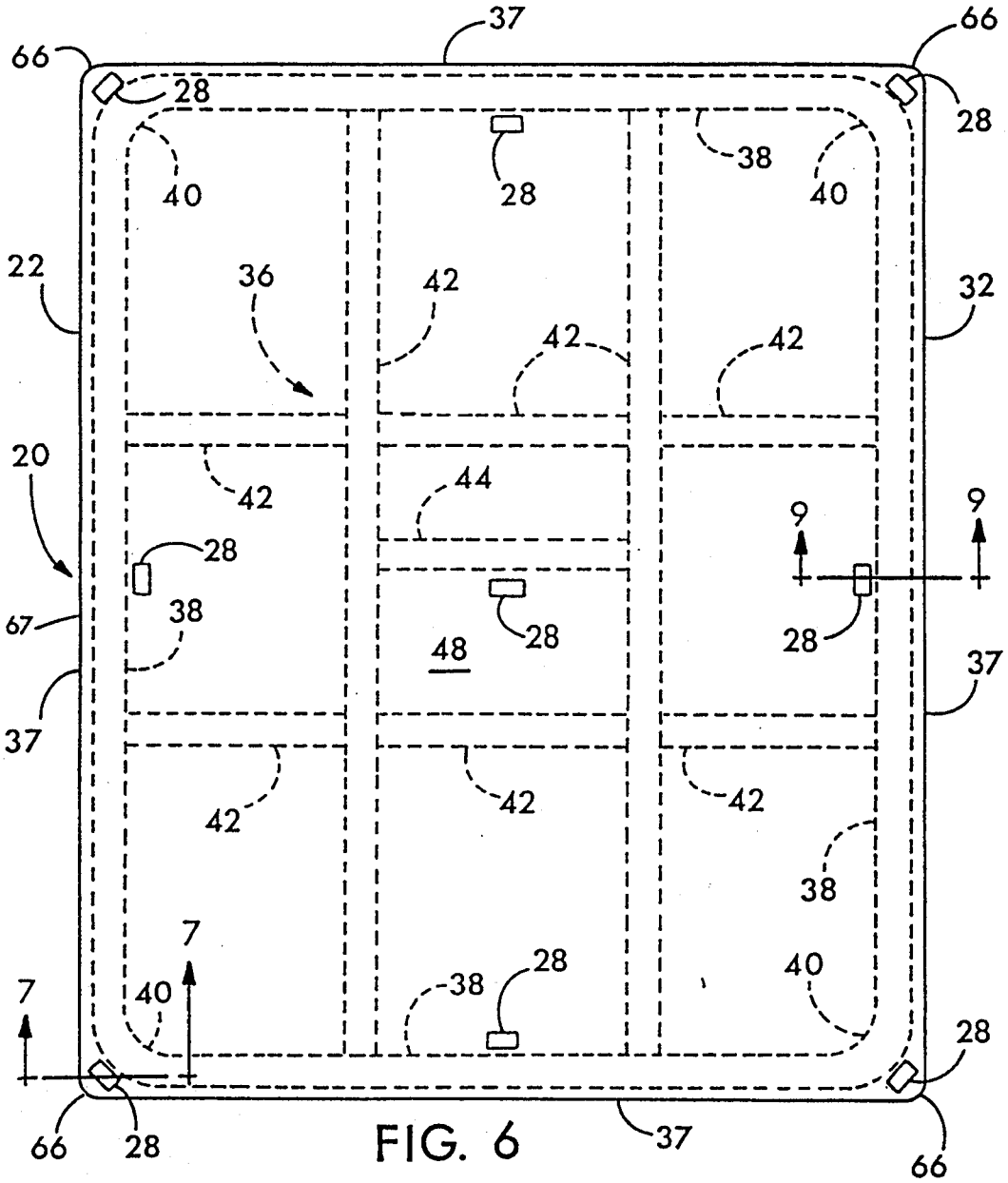
FIG. 6 is a top plan view of the pallet of FIG. 2.
Figure 8:
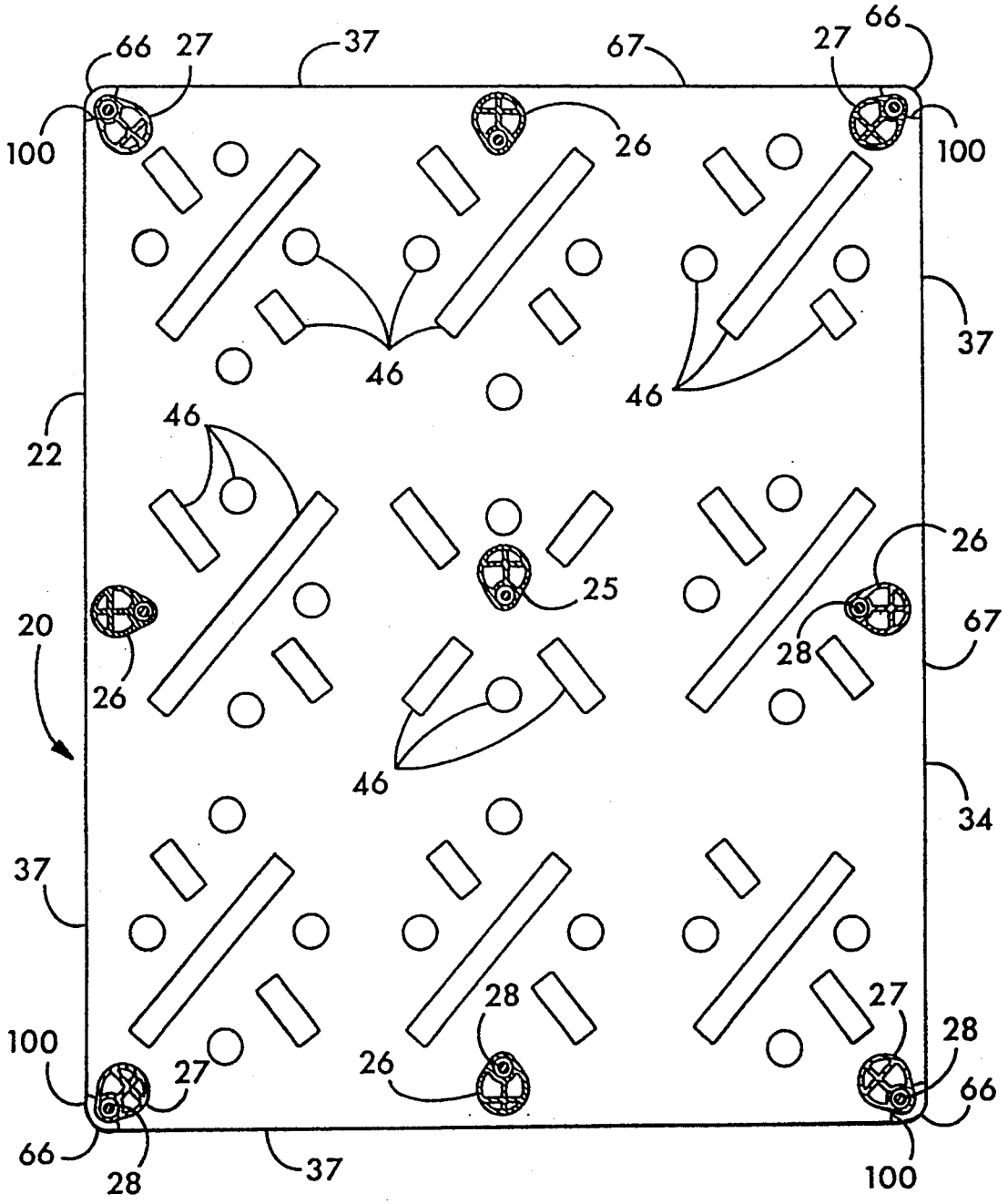
FIG. 8 is a cross-sectional view of the pallet of FIG. 2 taken along section line 8—8 showing the underside of the pallet top deck.

The top deck 22 of the pallet 20 is formed from an upper plastic sheet 32, shown in FIG. 6 and a lower plastic sheet 34 shown in FIG. 8, which enclose a tubular metal substrate 36.

The substrate 36, shown in hidden view in FIG. 6, is formed of bent and welded square steel tubing. The substrate 36 is inserted between the upper and lower sheets 32, 34 of the top deck 22 during the twin sheet thermoforming process, and is secured between the two sheets 32, 34 when they are fused together at multiple pinch points. The metal substrate 36, which is significantly stronger and stiffer than the plastic material of the top deck 22, serves to reinforce the top deck 22 to yield a top deck capable of supporting much greater loads than an unreinforced plastic deck without objectionable deflection of the deck surface.

Figure 9:
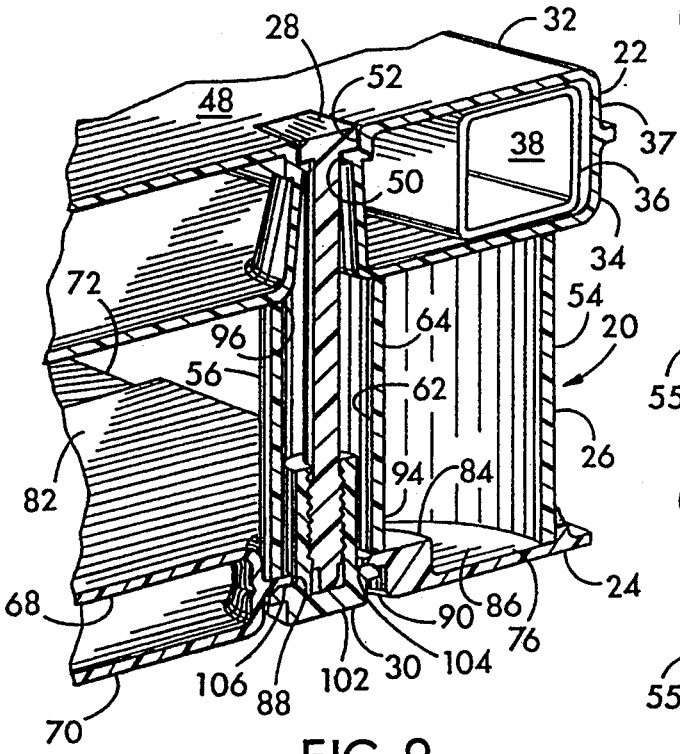
FIG. 9 is an isometric cross-sectional view of the pallet of FIG. 6 taken along section line 9—9.

In many applications fully loaded pallets are stored in vertical racks which have support brackets which extend inwardly beneath the bottom deck 24. For best performance, the reinforcing substrate should extend as close to the peripheral edges 37 of the top deck 22 as is possible. The substrate 36 has peripheral members 38 with radiused corners 40 conveniently formed from a single length of bent tubing. Linear interior members 42 are welded to the peripheral members 38 and a center member 44 is welded to two interior members 42 somewhat off center. As shown in FIG. 9, the peripheral members 38 are closely spaced from the peripheral edges 37 of the top deck 22.

Additional rigidity is imparted to the top deck by a pattern of reinforcing ribs 46, as shown in FIG. 8, which are formed in the lower sheet 34 of the top deck and which am fused to the upper sheet 32 of the top deck. The reinforcing ribs 46 are placed in separated areas to allow the insertion of the grid-like metal substrate 36 without interference with the ribs 46.

As shown in FIG. 6, the top surface 48 of the upper sheet 32 is substantially planar. The uninterrupted planar expanse of the top surface 48 provides a smooth surface for unhindered loading and unloading of the pallet 20. The smooth surface facilitates cleaning by allowing the spilled contents of containers loaded on the top deck 22 to be easily removed.

Figure 7:
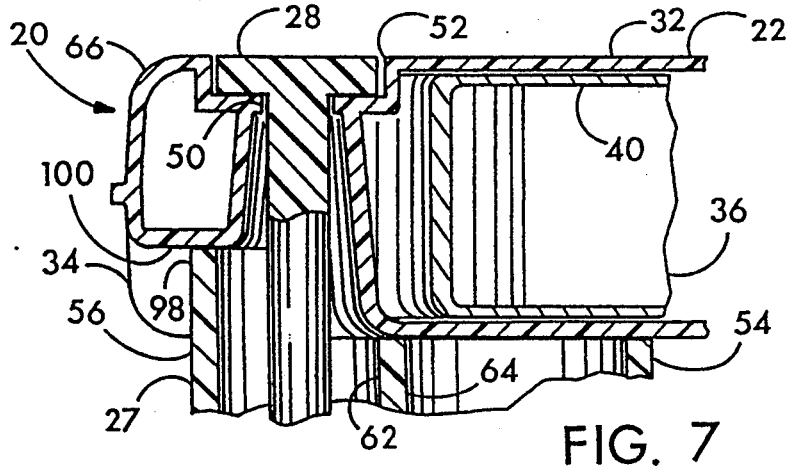
FIG. 7 is a fragmentary cross-sectional view of the pallet of FIG. 6 taken along section line 7—7.

The pallet 20 is of closed cell construction, which is particularly desirable for applications in the food industry. It is important for sanitation that there be no entrances for liquids, particularly organic material and bacteria, into the interior of a deck between the upper and lower sheets. Therefore, the bolt holes 50 which pierce the top deck 22 are drilled through sealed pinch points in the top deck where portions of the upper sheet 32 are fused to the lower sheet 34. Rectangular bolt head pockets 52, shown in FIGS. 7 and 9, are formed in the upper sheet 32 of the top deck 22 and receive the rectangular heads of the T-bolts 28. The bolt head pockets 52 and bolt holes 50 are horizontally spaced from the peripheral members 38 and radiused corners 40 of the substrate 36 and do not pass through or intersect any portion of the substrate 36. Exposure of the substrate to moisture, dirt, solvents, corrosives, contaminants or chemicals commonly found in the workplace would create unsanitary conditions as well as limit the effective life of the pallet. The T-bolts 28 preferably do not pass through the tubing of the reinforcing substrate 36, but pass along side of it. However, for most effective transmittal of loads from the metal substrate 36 to the bottom deck 24, it is desirable that the load-carrying portions of the post 26 be located directly below the tubular metal members of the substrate 36. The posts 26 are particularly designed to permit the effective transfer of loads from the substrate 36 to the bottom deck 24 while being connected to the top and bottom decks 22, 24 by bolts which do not pass through the substrate 36.

Figure 10:
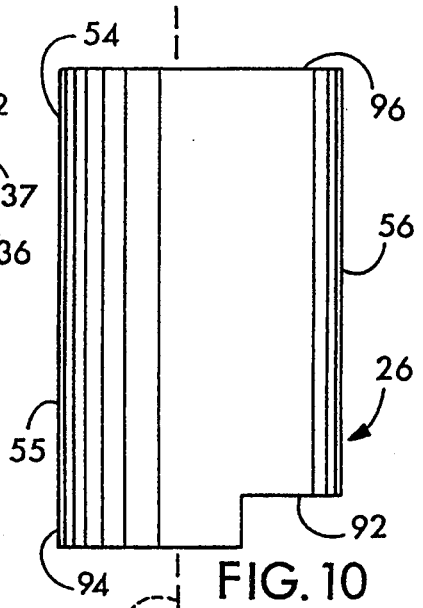
FIG. 10 is a side elevational view of a post of the pallet of FIG. 1.
Figure 11:
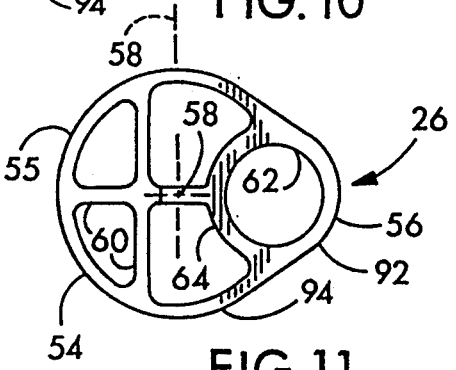
FIG. 11 is a bottom plan view of the post of FIG. 10.
Figure 12:
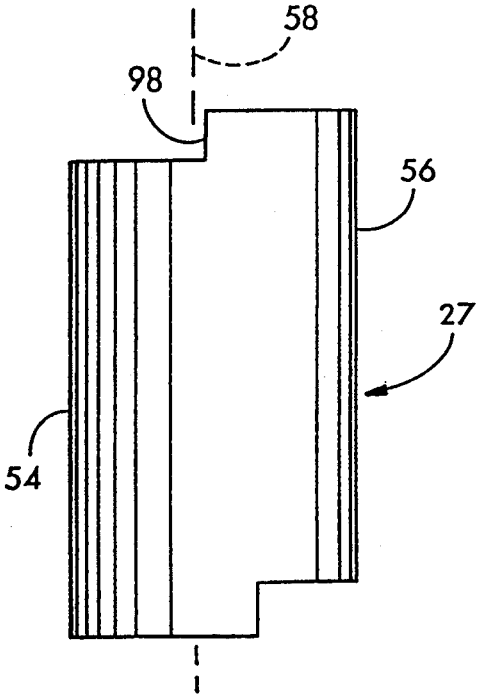
FIG. 12 is a side elevational view of a corner post of the pallet of FIG. 1.

As shown in FIGS. 10, 11 and 12, the posts 26, 27 are formed of extruded plastic material of constant cross-section with a generally teardrop shaped exterior profile, best shown in FIG. 11. Each post 26, 27 is formed of two structurally distinct but integrally joined portions 54, 56. The post 26 is composed of a support member 54 which is generally cylindrical with generally cylindrical vertically extending walls 55 and with a vertical central axis 58 located at the center of the cylindrical support member 54. The support member 54 has an exterior radius of approximately 1.2 inches. The wall thickness of the support member 54 is approximately fifteen hundredths of an inch. Two reinforcing members 60 are integrally formed within the support member 54 in a cross shape and extend vertically within the support member 54.

A bolt sleeve 56 is integrally formed with the support member 54 and has portions defining a vertical bolt hole 62. The bolt hole 62 is parallel to the central axis 58 of the support member 54 and is spaced from the central axis 58 so that the bolt hole is located exterior to the support member walls 55. The sleeve 56 is roughly cylindrical and has an exterior radius of approximately sixty-five hundredths of an inch and a wall thickness of approximately fifteen hundredths of an inch. The support member 54 and sleeve 56 of the post 26 share a common wall 64 but are each isolated from one another and the voids within each portion 54, 56 are non-communicating. The two joined cylindrical portions of the posts 26 give the posts 26 a somewhat teardrop shaped cross-section with the sleeve 56 serving to protect the T-bolt 28 inserted therein from damage and the support member 54 serving to carry the loads imposed upon the pallet top deck 22. The center post 25 and the corner posts 27 are identical to the side posts 26, although the corner posts may be formed with an upwardly extending portion as described below.

As shown in FIG. 6, the T-bolts 28 are inserted through the top deck 22 at different positions with respect to the metal substrate 36 depending on whether a post 26 is located at a corner 66 or intermediate between the corners along a linear side 67 of the top deck 22. As shown in FIG. 8, the side posts 26 are located along the sides 67 of the top deck with the support member 54 of the post directly beneath the substrate peripheral members 38 and with the sleeve 56 located inwardly from the peripheral members 38. By positioning the bolt holes 50 inward of the peripheral members 38 of the substrate 36, the peripheral members 38 may be positioned as close as possible to the peripheral edges 37 of the top deck to insure substantial reinforcement of the pallet 20 when rack mounted.

At the pallet corners 66, the substrate 36 has radiused corners 40 which are hence spaced somewhat from the peripheral edge 37 of the top deck 22 at the pallet corners 66. At the corners 66, it is not necessary to have reinforcement very close to the peripheral edge as the pallets 20 when rack mounted do not require that the corners 66 be engaged by the racks. Hence, the corner posts 27 are oriented with the support member 54 positioned beneath the radiused corners 40 of the substrate 36 and with the sleeve 56 located radially outwardly from the substrate 36. The center post 25 is positioned with the support member 54 directly below the center member 44 and with the sleeve 56 offset from the position of the substrate center member 44.

Figure 3:
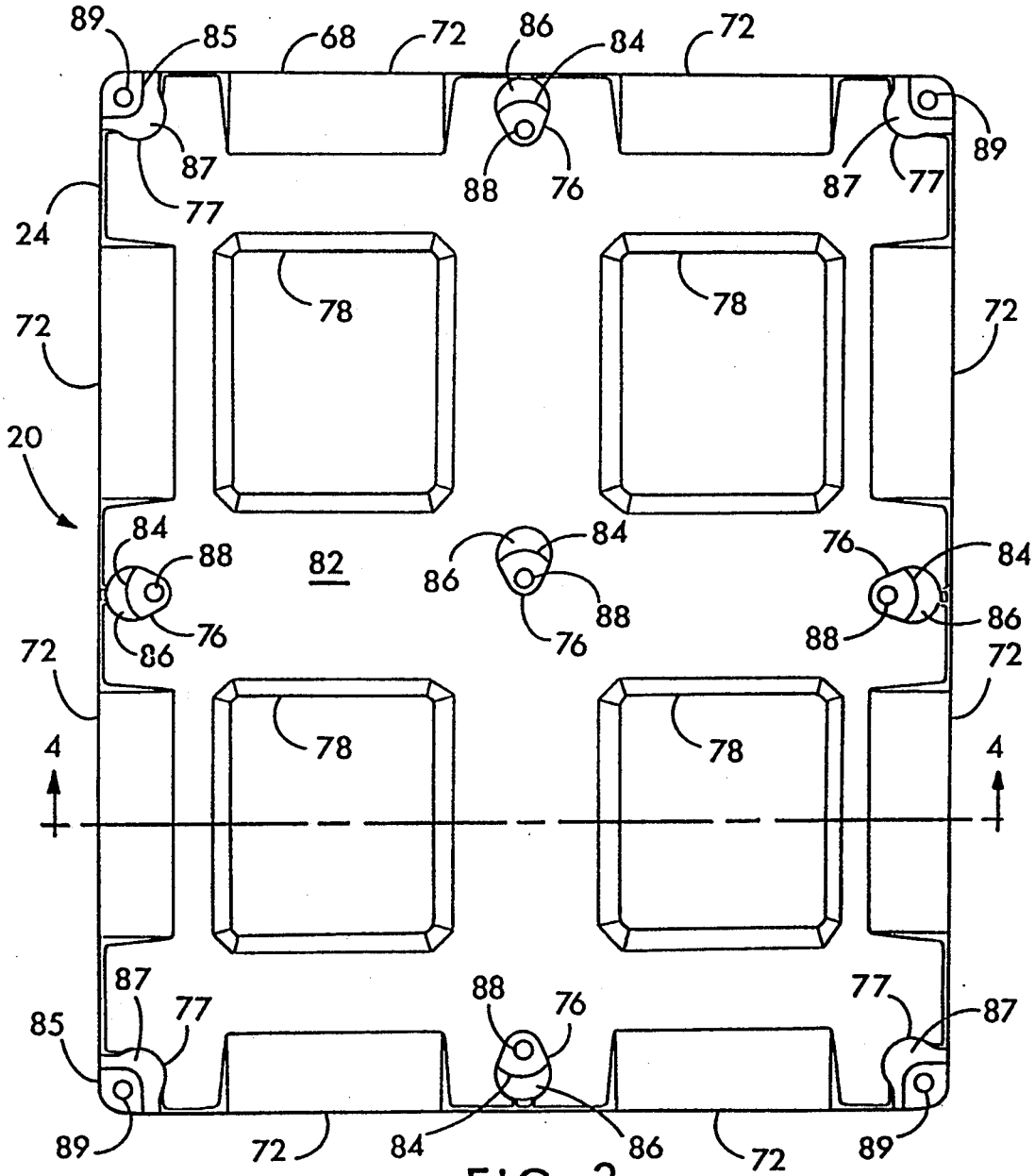
FIG. 3 is a cross-sectional view of the pallet of FIG. 2 taken along section line 3—3 showing the pallet bottom deck.
Figure 4:
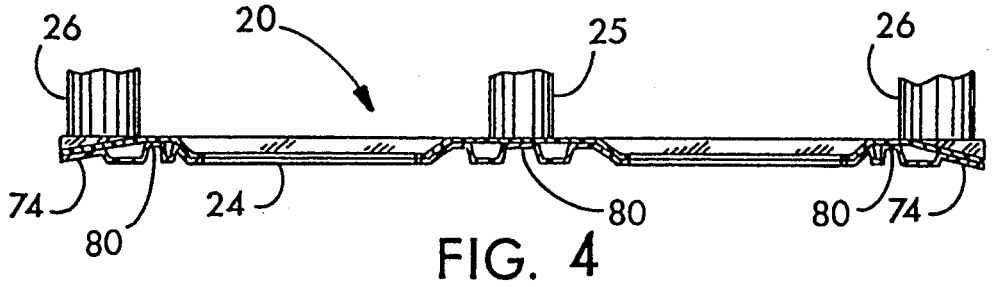
FIG. 4 is a fragmentary cross-sectional view of the pallet of FIG. 3 taken along section line 4—4.
Figure 5:
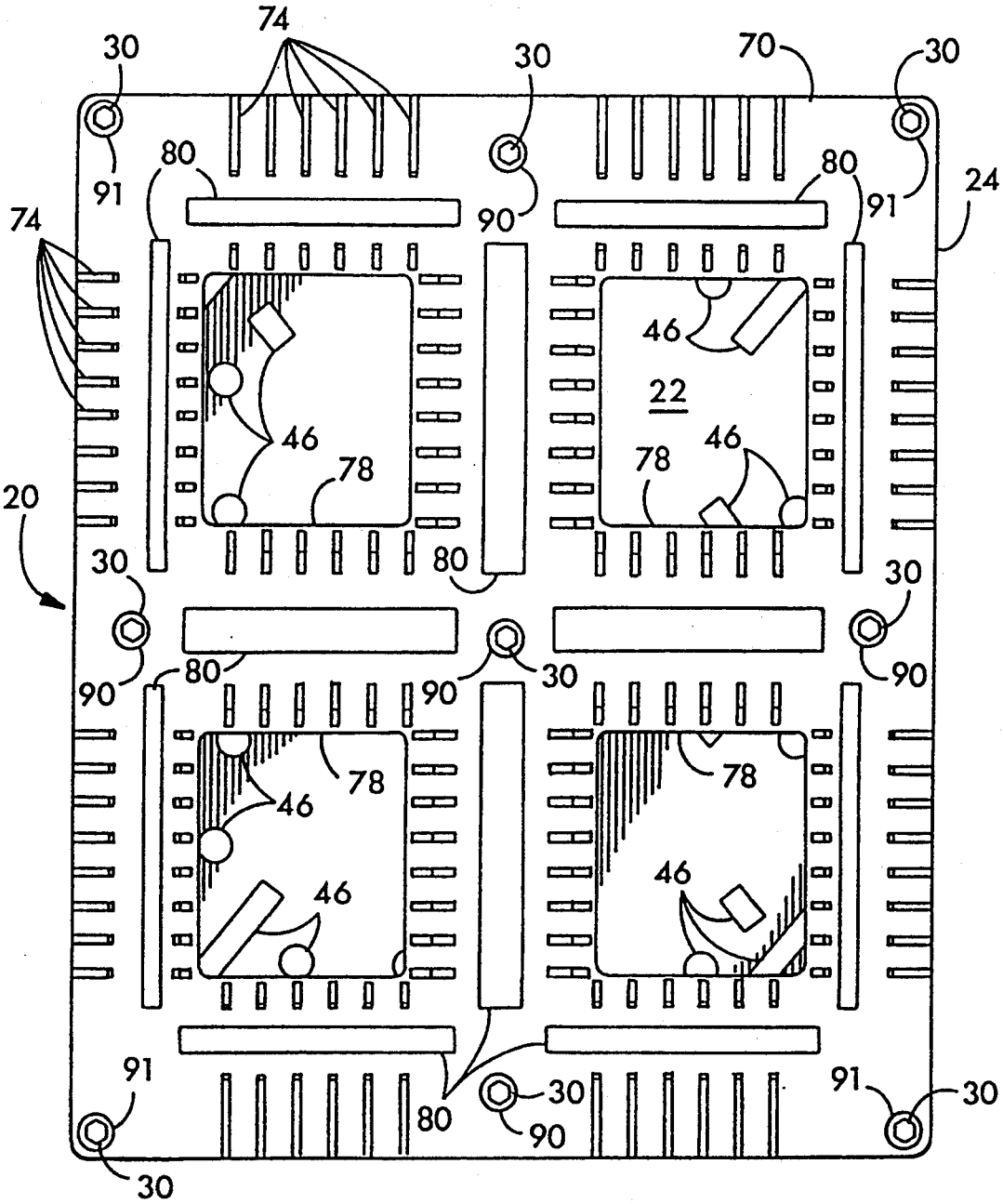
FIG. 5 is a bottom plan view of the pallet of FIG. 2.

The bottom deck 24 of the pallet 20 is also formed by a twin-sheet thermoforming process from an upper sheet 68, shown in FIG. 3, which is fused to a lower sheet 70, shown in FIG. 5. The bottom deck 24 supports the pallet and its contents when the pallet 20 is in storage either on a supporting surface or stacked upon another loaded pallet. The bottom deck 24 of the pallet 20 is not reinforced, although for particular applications a reinforcing substrate may be supplied within the bottom deck.

The bottom deck 24 is formed to facilitate four-way entry of the tines of an automotive or hand-operated forklift. Ramps 72 are formed in the bottom deck 24 between each pair of posts 26, 27. For clarity, the posts 25, 26, 27 have been omitted from the cross-sectional view of FIG. 3. The ramps 72 are formed by inclined portions of the upper sheet 68 which are fused to supporting ribs 74 formed on the lower sheet 70 and shown in FIGS. 4 and 5. Pockets 76, 77 are formed in the bottom deck 24 and are positioned beneath the posts 25, 26, 27 and are adapted to snugly receive the posts within the bottom deck 24.

The ramps 72 assist in smooth entry of the tines of a forklift vehicle beneath the top deck 22. The ramps 72 also serve to direct the tines away from contact with the posts 25, 26, 27 and hence contribute to longer post life. Four clearance holes 78 are routed out of the bottom deck 24 to provide clearance for the bearing wheels of a hand forklift tine. Ribs 80 are formed on the lower sheet 70 and fused to the upper sheet 68 to support the generally planar upper surface 82 of the bottom deck 24.

As best shown in FIGS. 3 and 9, each pocket 76, 77 has a platform 84, 85 raised approximately one-half inch above a floor 86, 87, respectively. The corner pockets 77 are formed with the platform 85 located radially outwardly from the floor 87. The floor 87 is a pinch point where the upper and lower sheets 68, 70 of the bottom deck 24 are fused together. A hole 89 is drilled through the floor 87 and the T-nut 30 is inserted therethrough. A nut head recess 91, shown in FIG. 5 is formed beneath the floor 87. The post pockets 76 located in the center and on the sides of the bottom deck 24 are generally teardrop in shape and are positioned directly below the corresponding posts 25, 26. The pockets 76 have platforms 84 raised above pocket floors 86 and have holes 88 formed in the platforms 84 for the admission of T-nuts 30 and have T-nut head recesses 90 formed beneath the platforms 84. The pockets 76, 77 locate the posts 25, 26, 27 and seal the open ends of the posts against the admission of liquid or debris.

As best shown in FIGS. 9, 10, 11 and 12 each post 25, 26, 27 has a recessed portion 92 formed at its base with a radius of approximately one and one eighth inch which is dimensioned to fit snugly over the elevated platforms 84, 85. The base 94 of each post is comprised of portions of the support member 54 and is positioned on the floor 86, 87 of a pocket 76, 77. The raised platforms 84, 85 above the nut recesses 90, 91, allow the lower sheet 70 of the bottom deck to be without any downward protrusions which would destabilize the pallet. The load-bearing support members 54 bear directly against the floors 86, 87 of the pockets 76, 77 which are formed of solid plastic material at pinch points between the upper and lower sheets 68, 70 of the bottom deck 24 and thus may transmit their loads directly to a bearing surface such as a floor or a truck bed or onto the loaded pallet beneath in a stacked array of pallets. The center post 25 is identical to the side posts 26 shown in FIG. 10 and has a planar top 96. The corner posts may be formed identically with the side posts 26, however, as shown in FIGS. 7 and 12, the corner posts 27 are formed with a protruding upper portion 98 to form a fight seal against the recessed corners 100 of the top deck 22. Alternatively, the corners 100 may be formed with a recess on the top surface of the deck to permit the use of standardized posts at all post positions.

Figure 13:
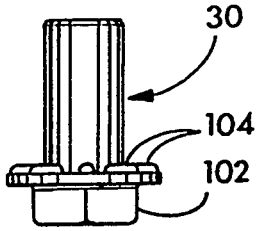
FIG. 13 is a side elevational view of a T-bolt nut of the pallet of FIG. 1.
Figure 14:
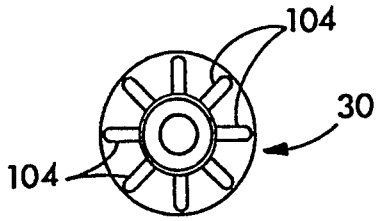
FIG. 14 is a bottom plan view of the nut of FIG. 13.

The pallet 20 is assembled, as best shown in FIG. 1, by inserting posts 25, 26, 27 between the top deck 22 and the bottom deck 24 and aligned within the pockets 76, 77. Identical T-bolts 28 are then inserted through the bolt holes 50 in the top deck 22 through the sleeves 56 of the posts 25, 26, 27, through the bolt holes 88, 89 in the bottom deck 24 where they are secured by the T-nuts 30 which are best shown in FIGS. 13 and 14. The T-nuts 30 have a head 102 with anti-turn ribs 104 formed radially thereon which mate within radial recesses 106 within the nut recesses 90, 91 on the lower sheet 70 of the bottom deck 24.

The assembled pallet 20 may be reused multiple times. Should a particular post be damaged due to some mishap or extended wear, that post may be unbolted from the pallet 20 assembly and replaced with a new post. The damaged post may then be returned for recycling. A loaded pallet 20 may be stored on a support surface, in stacked array, or on elevated racks.

It should be noted that for added snugness additional pockets corresponding to the shapes of the post tops 96 may be formed in the lower sheet 34 of the top deck 22 to receive the posts.

Figure 15:
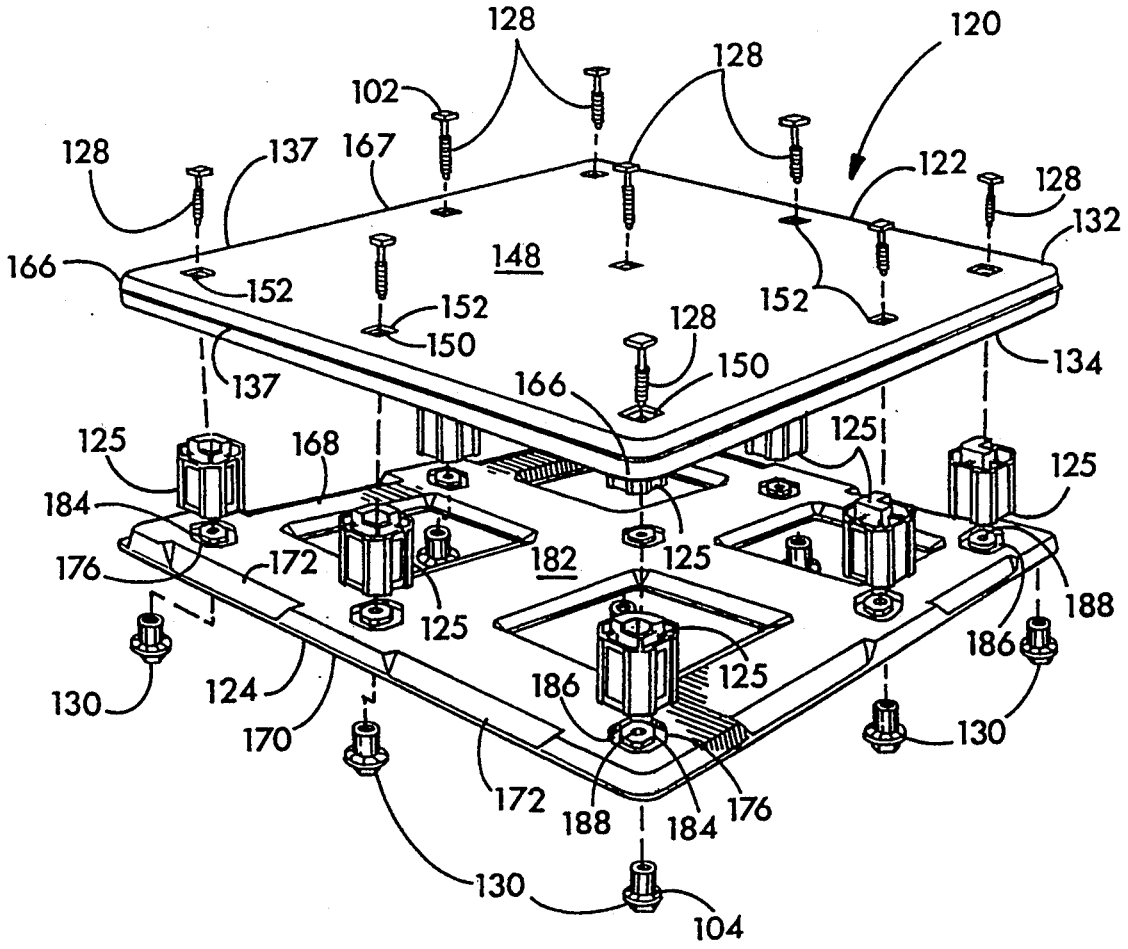
FIG. 15 is an exploded perspective view of an alternative embodiment of the double deck plastic pallet of this invention.
Figure 16:
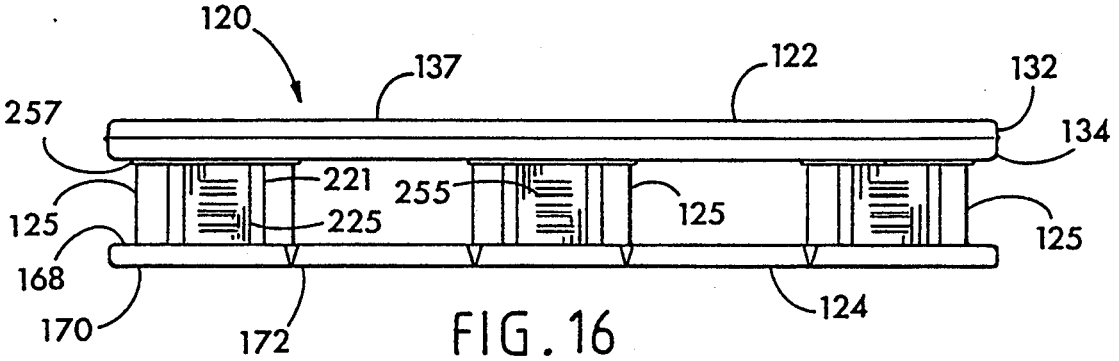
FIG. 16 is a side elevational view of the assembled pallet of FIG. 15.

An alternative embodiment of the double deck plastic pallet 120 of this invention is shown in FIGS. 15–28, with the component pans of the pallet 120 illustrated in FIG. 15. The pallet 120 is comprised of a twin-sheet thermoformed top deck 122 which is spaced from a twin-sheet thermoformed bottom deck 124 by a plurality of injection-molded plastic posts 125. The decks and posts are secured together by a plurality of bolts 128 and nuts 30. Each bolt 128 has a square head which is captured by a pocket 152 in the top deck 122.

The top deck 122 and the bottom deck 124 of the pallet 120 are manufactured by a twin-sheet thermoforming process. Each deck 122, 124 is thus formed from two heated sheets of thermoplastic resin material which are vacuum formed and fused together to form a unitary plastic structure. The thermoplastic sheets may be of virgin high density polyethylene. The structure of the pallet 120 is designed, however, to advantageously utilize recycled polyethylene materials, such as may be derived from recycled milk bottles.

Figure 18:
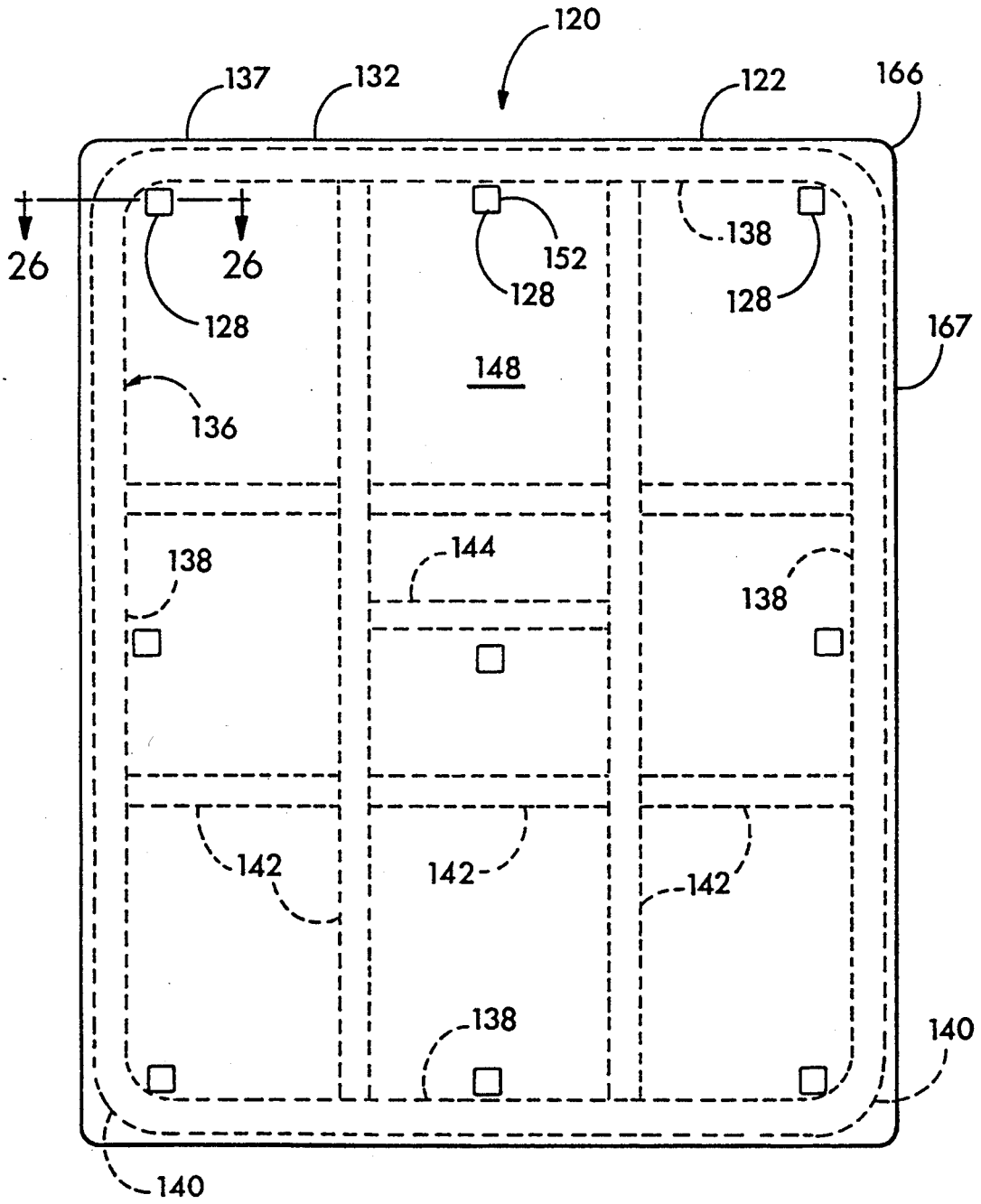
FIG. 18 is a top plan view of the pallet of FIG. 15.
Figure 19:
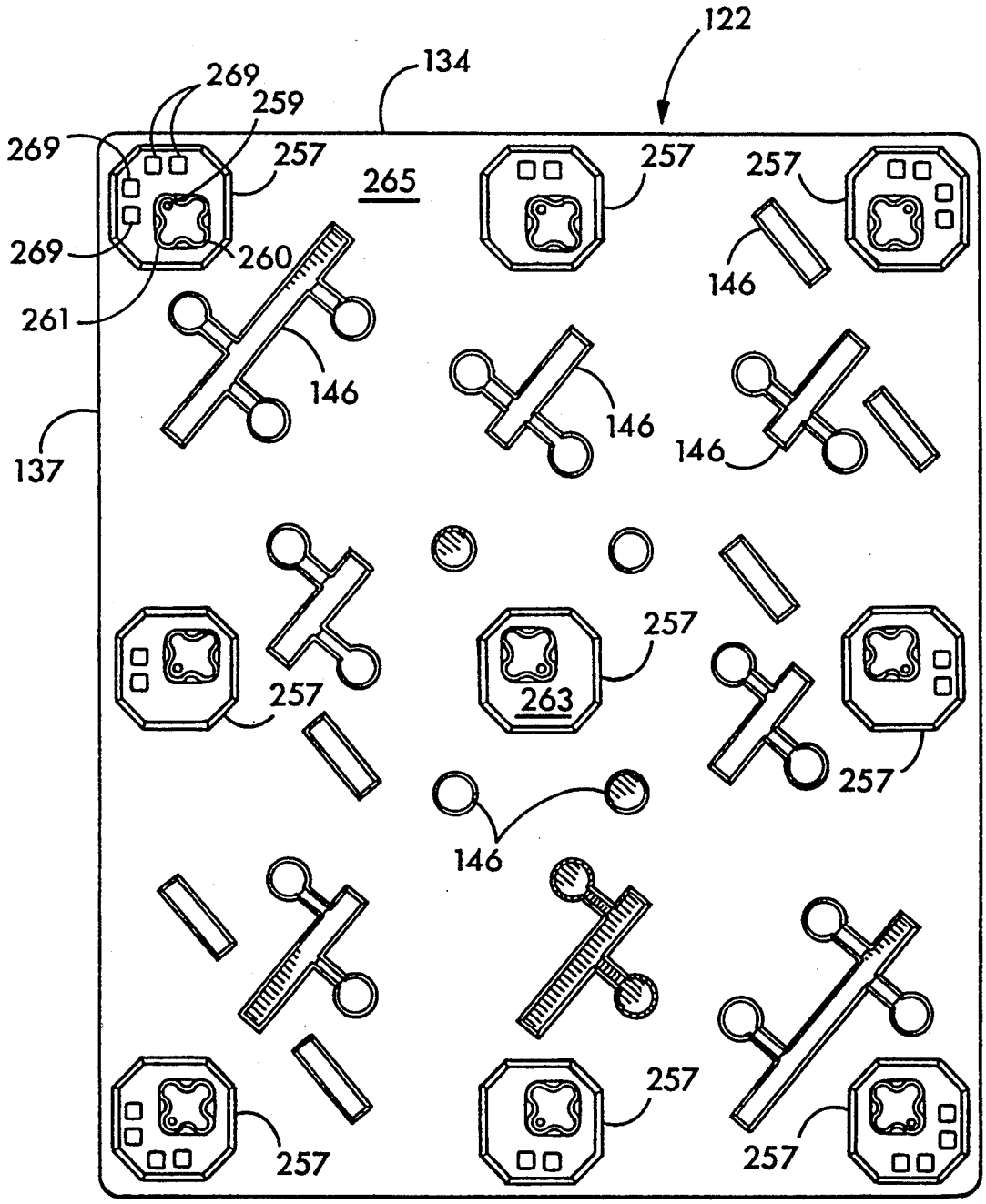
FIG. 19 is a bottom plan view of the top deck of the pallet of FIG. 15.
Figure 20:
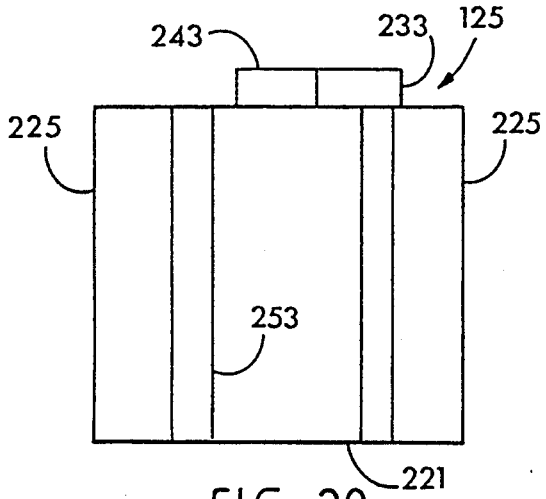
FIG. 20 is a side elevational view of a post of the pallet of FIG. 15.

The top deck 122 of the pallet 120 is formed from an upper plastic sheet 132, shown in FIG. 18 and a lower plastic sheet 134 shown in FIG. 19, which enclose a tubular metal substrate 136.

The substrate 136, shown in hidden view in FIG. 18, is formed of bent and welded square steel tubing. The substrate 136 is inserted between the upper and lower sheets 132, 134 of the top deck 122 during the twin sheet thermoforming process, and is secured between the two sheets 132, 134 when they are fused together at multiple pinch points. The metal substrate 136, which is significantly stronger and stiffer than the plastic material of the top deck 122, serves to reinforce the top deck 122 to yield a top deck capable of supporting much greater loads than an unreinforced plastic deck without objectionable deflection of the deck surface.

The reinforcing substrate 136 extends closely spaced from the peripheral edges 137 of the top deck 122. As shown in FIG. 18, the substrate 136 has peripheral members 138 with radiused corners 140 conveniently formed from a single length of bent tubing. Linear interior members 142 are welded to the peripheral members 138 and a center member 144 is welded to two interior members 142 somewhat off center.

Additional rigidity is imparted to the top deck by a pattern of reinforcing ribs 146, as shown in FIG. 19, which are formed in the lower sheet 134 of the top deck and which are fused to the upper sheet 132 of the top deck. The reinforcing ribs 146 are placed in separated areas to allow the insertion of the grid-like metal substrate 136 without interference with the ribs 146.

As shown in FIG. 18, the top surface 148 of the upper sheet 132 is substantially planar. The uninterrupted planar expanse of the top surface 148 provides a smooth surface for unhindered loading and unloading of the pallet 120. The smooth surface facilitates cleaning by allowing the spilled contents of containers loaded on the top deck 122 to be easily removed.

The pallet 120 is of closed cell construction, which is particularly desirable for applications in the food industry. It is important for sanitation that there be no entrances for liquids, particularly organic material and bacteria, into the interior of a deck between the upper and lower sheets. Therefore, the bolt holes 150 which pierce the top deck 122 are drilled through sealed pinch points in the top deck where portions of the upper sheet 132 are fused to the lower sheet 134. Square bolt head pockets 152, shown in FIG. 15, are formed in the upper sheet 32 of the top deck 122 and receive the square heads of the bolts 128. The bolt head pockets 152 and bolt holes 150 are horizontally spaced inwardly from the peripheral members 138 and radiused corners 140 of the substrate 136 and do not pass through or intersect any portion of the substrate 136. Exposure of the substrate to moisture, dirt, solvents, corrosives, contaminants or chemicals commonly found in the workplace would create unsanitary conditions as well as limit the effective life of the pallet. The bolts 128 preferably do not pass through the tubing of the reinforcing substrate 136, but pass along side of it. However, for most effective transmittal of loads from the metal substrate 136 to the bottom deck 124, it is desirable that load-carrying portions of the post 125 be located directly below the tubular metal members of the substrate 136. The posts 125 are particularly designed to permit the effective transfer of loads from the substrate 136 to the bottom deck 124 while being connected to the top and bottom decks 122, 124 by bolts which do not pass through the substrate 136.

Posts 125, best shown in FIGS. 20–26, are stiff octagonal plastic support columns which carry the loads applied to the top deck 122 to the bottom deck 124. For reduced weight and cost, each post 125 is not solid, but is comprised of a number of integral walls and webs of approximately one-eighth inch thickness. Each post has eight walls 221, 223, 225: two outside walls 221, which are perpendicular to one another and aligned with the sides of the pallet 120; two inside walls 223 also perpendicular to one another and spaced in parallel relation from the outside walls 221; and four corner walls 225, which are shorter than the inside and outside walls and which connect adjacent inside and outside walls. It is the post outside walls 221 which engage against and support the substrate-reinforced portions of the top deck. The outside walls 221—and those corner walls 225 adjacent thereto—act as a support member for transferring much of the load from the reinforced portions of the top deck 122 to the bottom deck 124.

A square tubular bolt sleeve 231, which is open at the top and bottom, is centered within the post 125. A generally L-shaped stiffening column 233 extends vertically within the post 125 adjacent the sleeve 231 with the two legs 235 of the L defining portions of the bolt sleeve 231. Vertically extending planar webs 239 extend from the outside and inside walls 221, 223 to the stiffening column 233. Two webs 241 extend from opposed corner walls 225 to the stiffening column 233 and bolt sleeve 231. The corner wall webs 241 define an axis of symmetry for the post 125.

Figure 25:
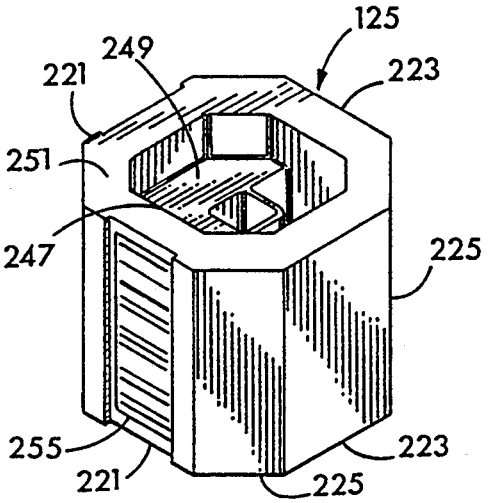
FIG. 25 is a bottom isometric view of the post of FIG. 20.

The stiffening column 233 extends above the height of the walls 221, 223, 225 to form an L-shaped protrusion 243 which is closed by a planar surface 245. On the bottom of each post 125, as best shown in FIG. 25, an octagonal depression 247 is formed which is centered within the post 125. A surface 249 recessed within the post defines the upper limits of the depression 247. A planar ring octagonal surface 251 defines the bottom of the post 125.

Figure 22:
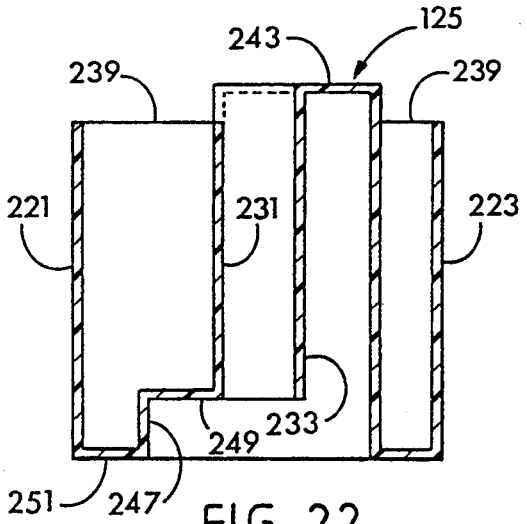
FIG. 22 is a cross-sectional view of the post of FIG. 21 taken along section line 22—22.
Figure 21:
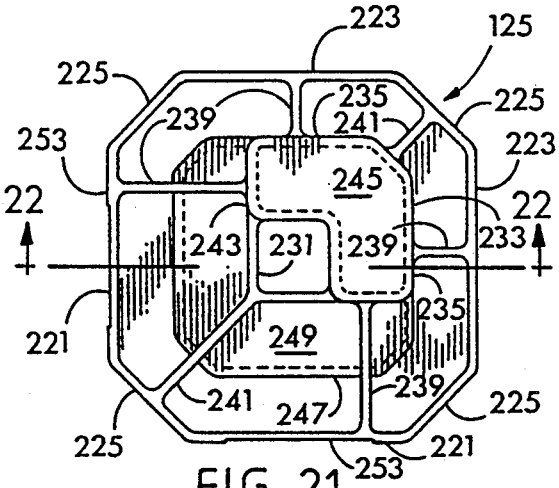
FIG. 21 is a top plan view of the post of FIG. 20.
Figure 23:
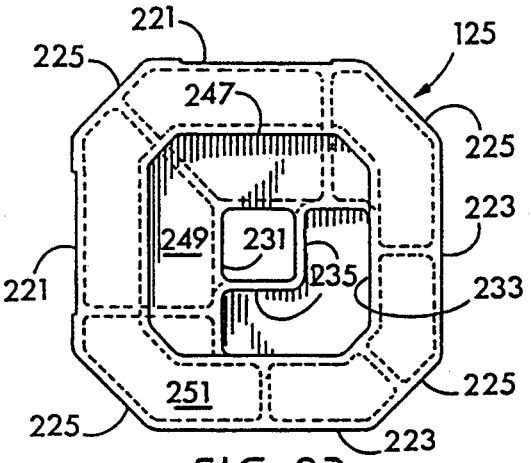
FIG. 23 is a bottom plan view of the post of FIG. 20.
Figure 24:
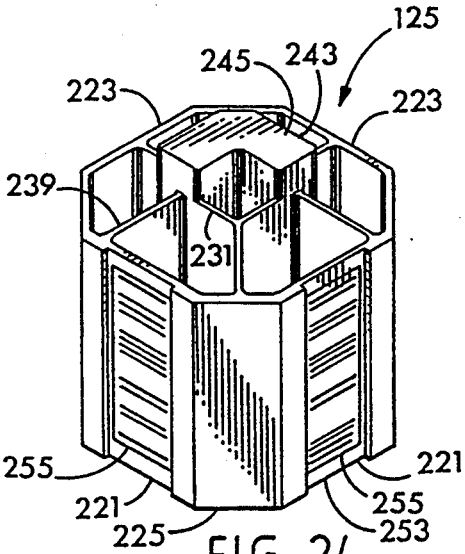
FIG. 24 is top isometric view of the post of FIG. 20.

As best shown in FIG. 22, the surfaces 245, 249, 251 form a barrier which prohibits the passage of gasses, liquids, dirt or particulate matter through the post 125 at any location except for through the bolt sleeve 231. Each outside wall 221 has a recess 253 formed therein and extending vertically. Each recess 253 is adapted to receive an adhesive label containing machine-readable information relevant to the contents of a particular pallet. Labels 255 marked with conventional bar codes when placed on the outside walls 221 will be appropriately positioned for convenient data entry either by a portable scanner or a scanner fixed in the path of travel of a particular pallet.

In an exemplary pallet, each post 125 is approximately five inches wide. The bolt sleeve 231 is approximately one inch wide. The post 125 is approximately four and five-eighths inches tall with the L-shaped protrusion 243 extending one-half inch above the top of the post.

Figure 27:
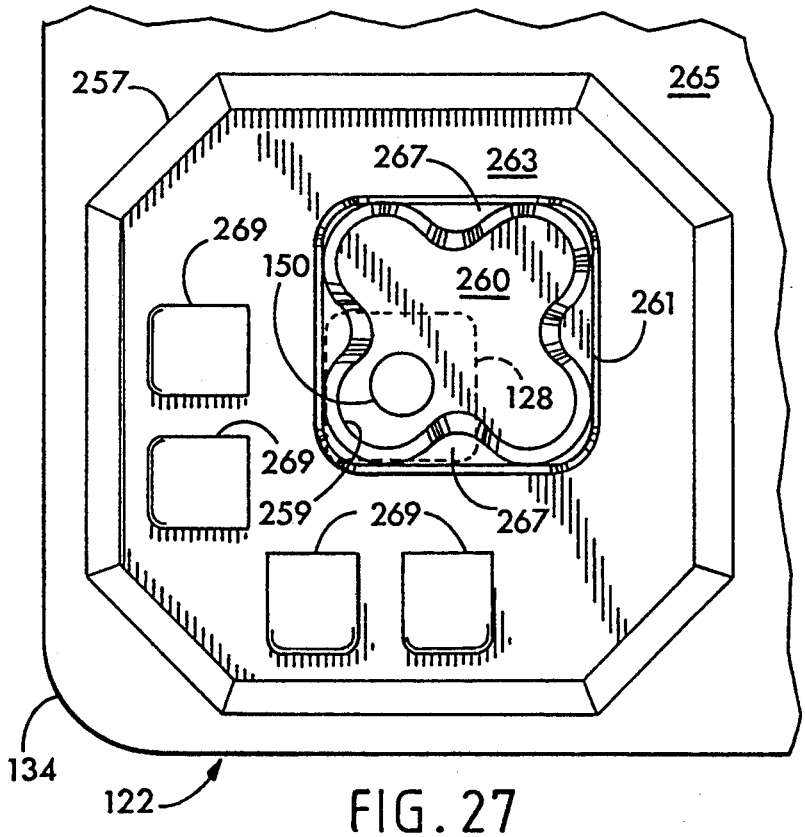
FIG. 27 is a fragmentary plan view of the underside of the pallet top deck of FIG. 19.
Figure 28:
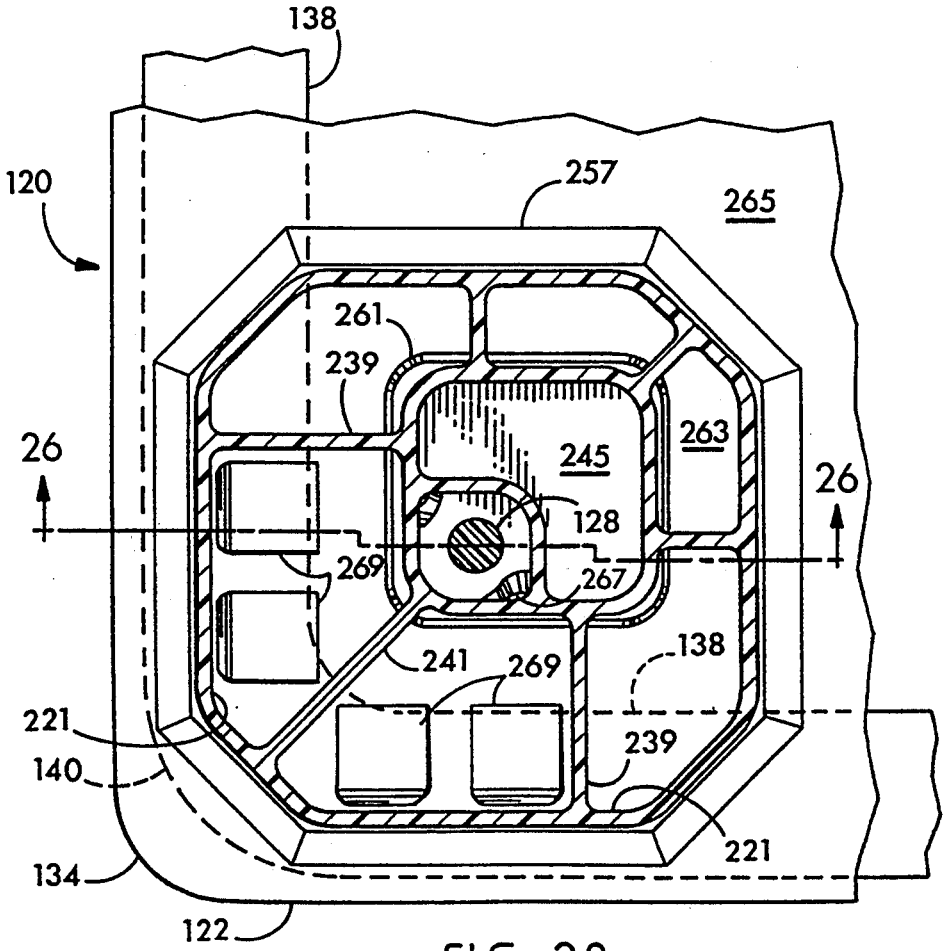
FIG. 28 is a cross-sectional view of the pallet of FIG. 26 taken along section line 28—28.

As shown in FIG. 27, structure is formed in the lower sheet 134 of the top deck 132 which engages with, locates, and supports against lateral deflection the posts 125. Surrounding each bolt hole 150 in the top deck 122 on the lower sheet 134 is an octagonal ridge 257 with dimensions slightly greater than those of the post 125. The ridge 257 serves to locate the post 125 and also forms a seal around the post to reduce the admittance of liquids and other debris. The bolt hole 150 is centered within the ridge 257 and passes through a pinch point at one lobe 259 of the four-lobed X-shaped base 260 of a depression 261 formed within the octagonal ridge 257. The surface 263 which extends between the depression 261 and the ridge 257 is at substantially the same level as the lower surface 265 of the top deck 122. The X-shaped base 260 of the depression 261 is depressed approximately one and three-eighths inch from the surface 263 within the ridge 257. A shoulder 267 is formed within the depression 261 and is spaced approximately one inch from the base 260 and approximately three-eighths inch from the lower surface 265 of the top deck. The shoulder engages against the L-shaped protrusion 243 of a post 125.

The center of the depression 261 is offset from the center of the octagonal ridge 257. The placement of the depression 261 with respect to the bolt hole 150 is equivalent to the relation between the L-shaped protrusion 243 and the bolt sleeve 231 on the post 125. This arrangement facilitates rapid assembly of the pallet 120 by permitting the quick and proper orientation of each post 125 within the octagonal ridge 257 such that the outside walls 221 of each post 125 will always face the outside of the pallet, hence permitting the bar code labels 255 to remain visible and the outside supporting walls to be always properly positioned with respect to the reinforcing substrate. The L-shaped protrusion 243 is supported on the shoulder 267 above three lobes 259 of the X-shaped base 260 such that a bolt sleeve 231 is properly aligned with the bolt hole 150.

Figure 17:
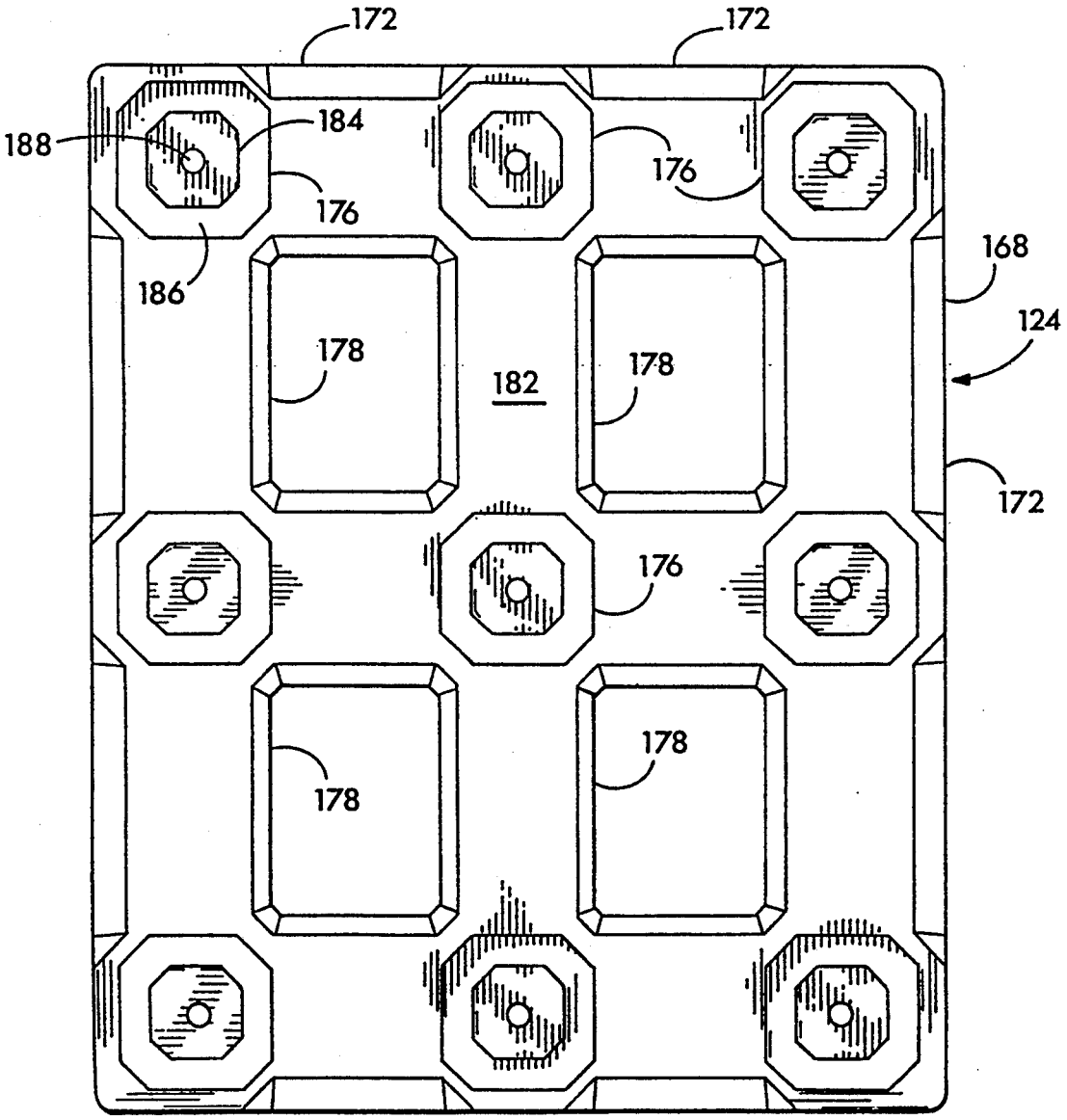
FIG. 17 is a top plan view of the bottom deck of the pallet of FIG. 15.
Figure 29:
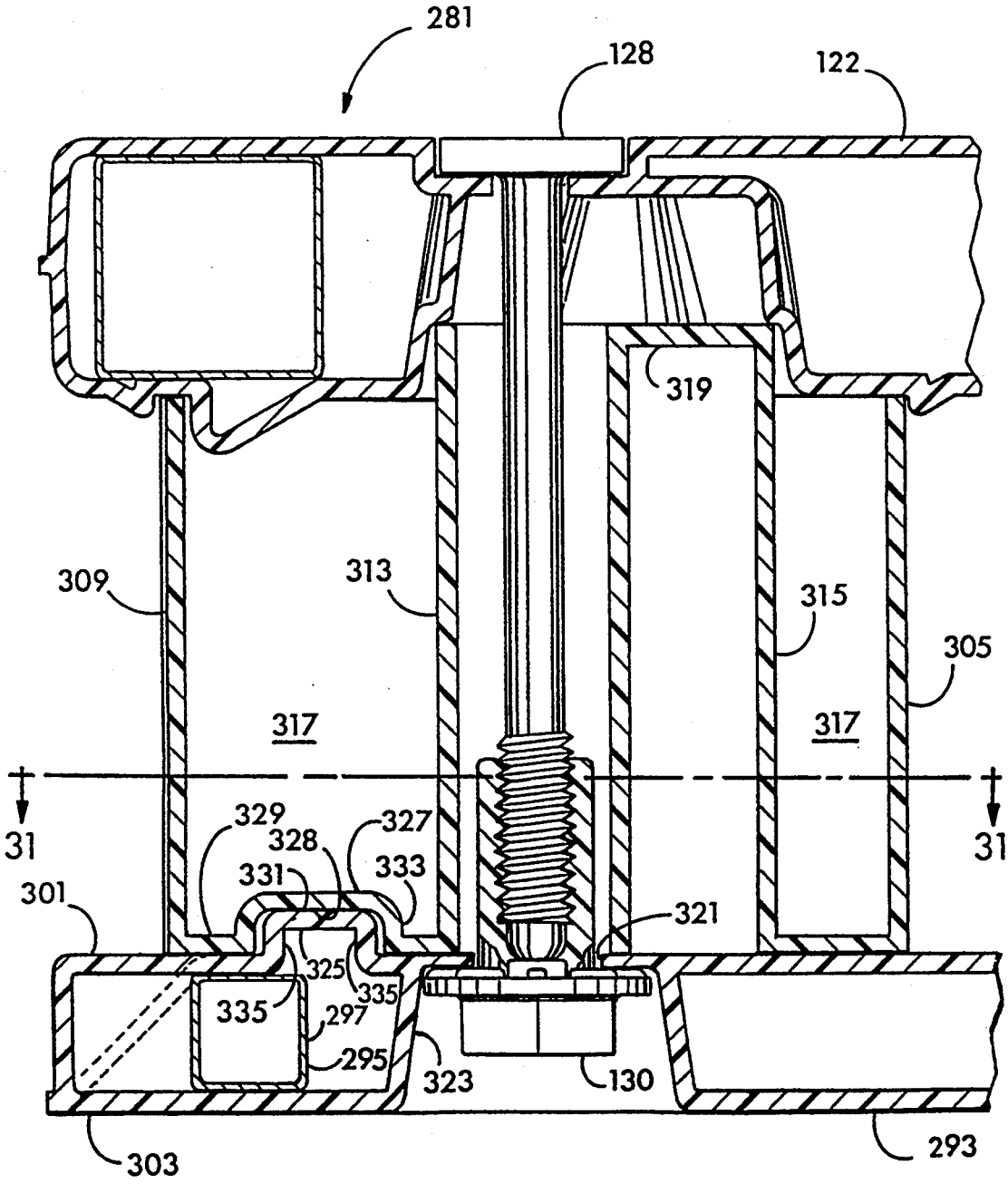
FIG. 29 is a fragmentary cross-sectional view of an alternative embodiment of the pallet of this invention having a reinforced bottom deck.

Protruding detents 269, shown in FIGS. 27 and 29, extend from the surface 263 within the ridge 257. The detents 269 are located within the ridges 257 along the corners and sides of the pallet 120 and serve to restrain inward deflection of the posts 125 as the result of a lateral blow from an obstacle or the tines of a forklift. As best shown in FIG. 17, the detents 269 are spaced inwardly somewhat from the outside walls 221 of the post 125 and do not snugly engage said walls between the detents and the ridge 257. When the post 125 is deflected, however, the detents 269 will prevent movement of the post against the bolt 128 which would tend to shear the bolt or otherwise damage it.

Figure 26:
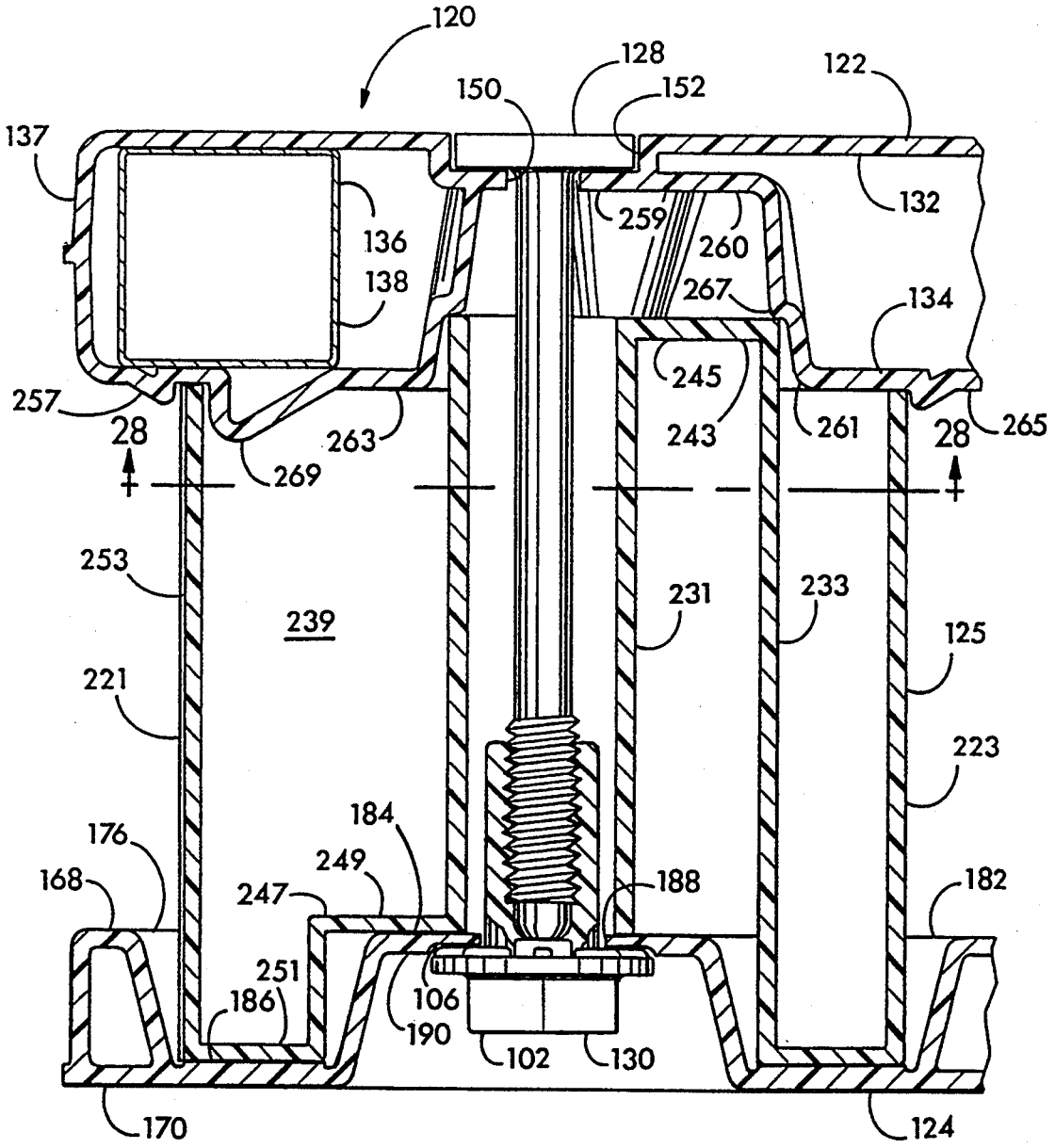
FIG. 26 is a fragmentary cross-sectional view of the pallet of FIG. 18 taken along section line 26—26.

As shown in FIGS. 17 and 26, octagonal pockets 176 are formed in the bottom deck 124. Each pocket 176 has an octagonal floor 186, which engages against the bottom surface 251 of a post 125. The floor is located at a pinch point where the upper and lower sheets 168, 170 of the bottom deck 124 are fused together. A platform 184 is raised approximately seven-eights inch above the floor 186 and has a hole 188 drilled therethrough which is positioned beneath the bolt hole 150 in the top deck 122 and beneath the sleeve 231 of a post 125. The platform 184 is also formed at a pinch point. A nut head recess 190 shown in FIG. 26 is formed beneath the platform 184. The pockets 176 thus surround the posts 125 holding them in place and preventing the entry of liquids and dust into the posts.

The bottom deck 124 of the pallet 120 is also formed by a twin-sheet thermoforming process from an upper sheet 168, shown in FIG. 17, which is fused to a lower sheet 170, shown in FIG. 26. The bottom deck 124 supports the pallet and its contents when the pallet 120 is in storage either on a supporting surface, racked or stacked upon another loaded pallet. The bottom deck 124 of the pallet 120 for moderate loads need not be reinforced, although for particular applications a reinforcing substrate may be supplied within the bottom deck, as described below.

The bottom deck 124 is formed to facilitate four-way entry of the tines of an automotive or hand-operated forklift. Ramps 172 are formed in the bottom deck 124 between each pair of outside posts 125. The ramps 172 are formed by inclined portions of the upper sheet 168 which are fused to supporting ribs (not shown) formed on the lower sheet 170 similar to ribs 74 in the pallet 20. Pockets 176 are formed in the bottom deck 124 and are positioned beneath the posts 125, and are adapted to snugly receive the posts within the bottom deck 124.

The ramps 172 assist in smooth entry of the tines of a forklift vehicle beneath the top deck 122. The ramps 172 also serve to direct the tines away from contact with the posts 125 and hence contribute to longer post life. Four clearance holes 178 are routed out of the bottom deck 124 to provide clearance for the bearing wheels of a hand forklift fine. Ribs are formed on the lower sheet 170 and fused to the upper sheet 168 to support the generally planar upper surface 182 of the bottom deck 124.

The pallet 120 is assembled, as best shown in FIG. 1, by inserting posts 125 between the top deck 122 and the bottom deck 124 and aligned within the pockets 176 and ridges 257. Identical bolts 128 are then inserted through the bolt holes 150 in the top deck 122 through the sleeves 231 of the posts 125 through the bolt holes 188 in the bottom deck 124 where they are secured by the nuts 30 which are best shown in FIGS. 13 and 14. The nuts 30 have a head 102 with anti-turn ribs 104 formed radially thereon which mate within radial recesses 106 within the nut recesses 190 on the lower sheet 170 of the bottom deck 124.

The assembled pallet 120 may be reused multiple times. Should a particular post be damaged due to some mishap or extended wear, that post may be unbolted from the pallet 120 assembly and replaced with a new post. The damaged post may then be returned for recycling. A loaded pallet 120 may be stored on a support surface, in stacked array, or on elevated racks.

In particular applications, for example when palletizing particularly heavy loads, it is desirable to employ a pallet 281 having a bottom deck 293 which is reinforced with a metal substrate 295. This substrate is preferably formed of square steel tubing approximately three-quarters inch wide. As shown in FIGS. 29–36, the reinforced bottom deck pallet 281 utilizes a top deck 122, bolts 128, and nuts 30, which are identical in all respects to those of the pallet 120.

Figure 30:
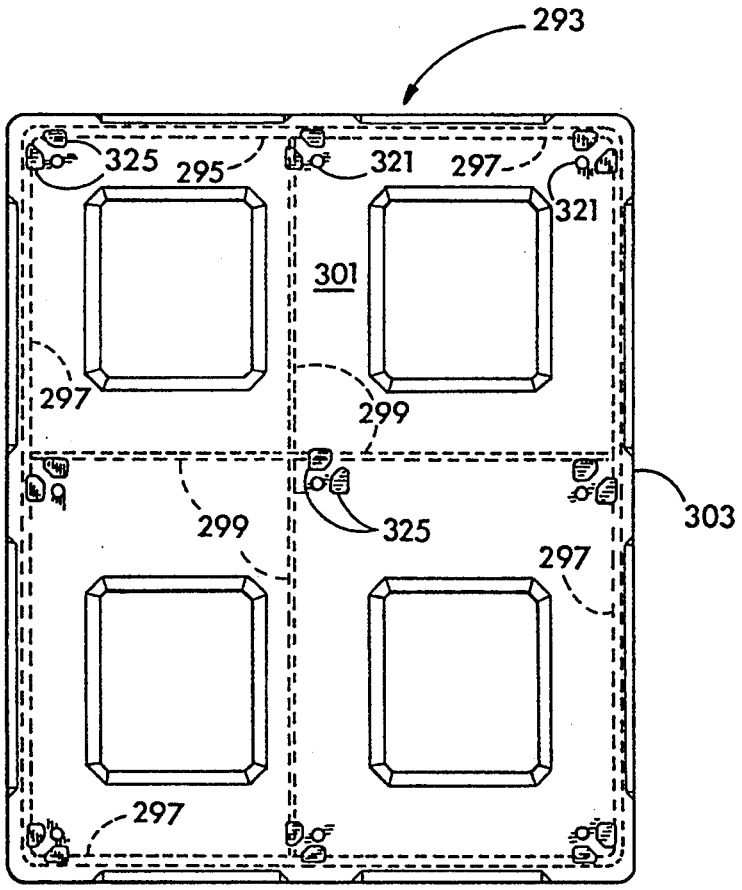
FIG. 30 is a top plan view of the bottom deck of the pallet of FIG. 29.
Figure 31:
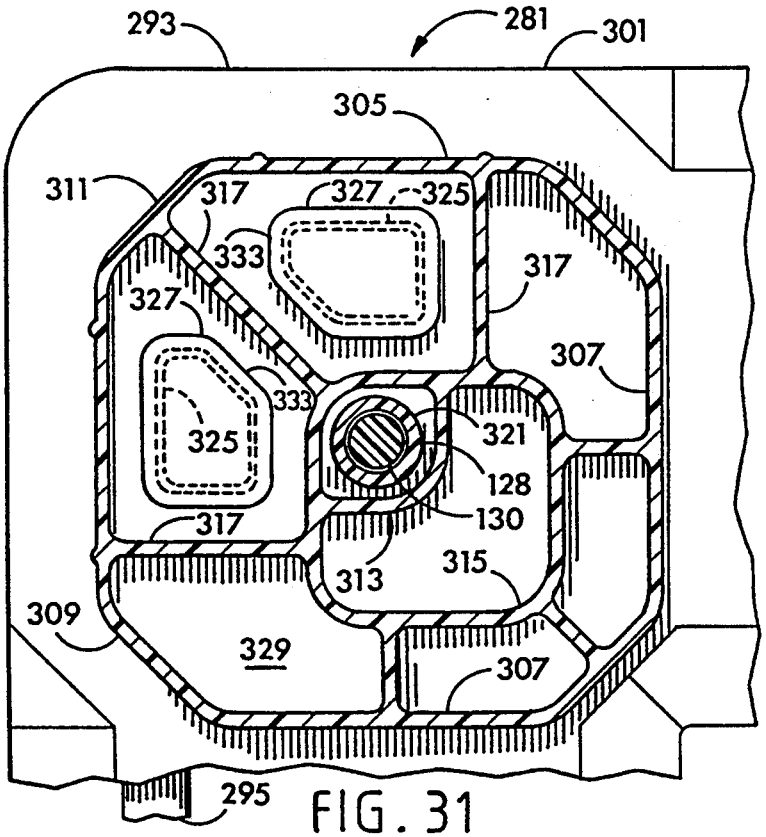
FIG. 31 is a cross-section view of the pallet of FIG. 29 taken along section 31—31.

The tubular metal substrate 295, shown in hidden view in FIG. 30, has peripheral members 297 and interior members 299 which are molded between the bottom deck upper sheet 301 and the bottom deck lower sheet 303. The upper and lower sheets 301, 303 are fused such that the substrate 295 is entirely enclosed within the plastic material and is not exposed to the environment.

The reinforced bottom deck 293 is connected to the top deck 122 by nine posts 305. Each post 305 for the reinforced bottom deck pallet 281 is similar to the post 125 in the pallet 120 and has inside and outside walls 307, 309 connected by corner walls 311 with an interior sleeve 313 and stiffening column 315 joined by webs 317 to the walls 307, 309, 311. The post 305 also has an L-shaped protrusion 319 identical to the protrusion 243 on the post 125.

Because of the placement of the metal substrate 295 around the perimeter of the bottom deck 293, octagonal pockets such as those on the pallet 120 may not be formed at a constant depth within the bottom deck. The reinforced bottom deck 293 has bolt holes 321 formed at pinch points between the upper sheet 301 and lower sheet 303 above a nut recess 323 for receiving the nut 30. Two polygonal protrusions 325 extend upwardly from the upper sheet 301 beneath each post 305. Each post 305 has two polygonal recesses 327, which are shaped to receive and engage against the protrusions 325. The recesses 327 extend inwardly from a planar bottom surface 329 of the post 325. The engagement of the protrusions 325 within the recesses 327 prevents the posts 305 from rotating within the assembled pallet 281. At least one outside wall 309 of each post 305 is thus in a position above the metal substrate 295 to transmit loads from the top deck to the bottom deck 293.

The recesses 327 are five-sided, generally in the shape of a rectangle with a single truncated corner. Each recess 326 is like an inverted cup which extends from the planar base 330 of the post 305. Each recess 327 has an upper polygonal surface 328 which engages against the upper surface 331. The walls 333 of the recess which extend from the upper surface 331 to the base 330 of the post 305 may engage against the walls 335 of the protrusion 325 to restrict horizontal motion of the post 305 with respect to the bottom deck 293.

Figure 32:
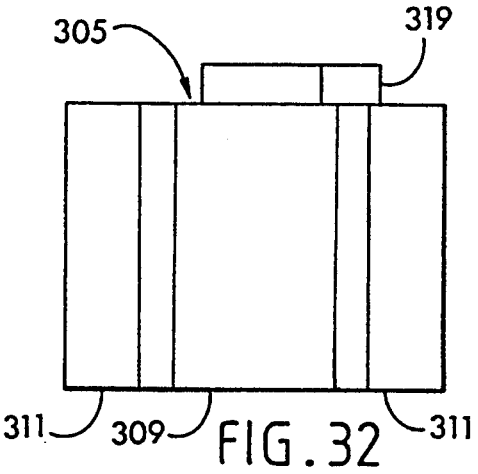
FIG. 32 is a side elevational view of a post of the pallet of FIG. 29.
Figure 34:
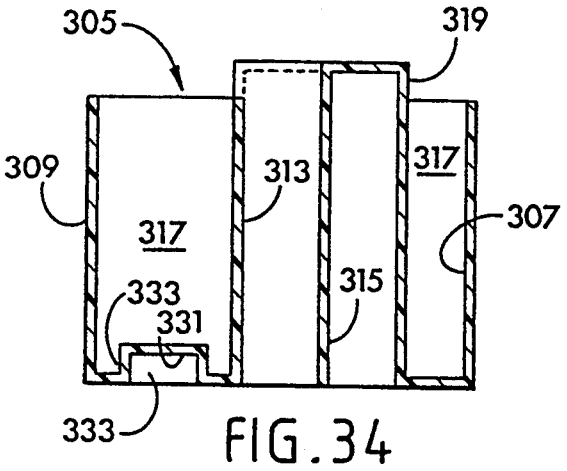
FIG. 34 is a cross-sectional view of the post of FIG. 32 taken along section line 22—22.
Figure 33:
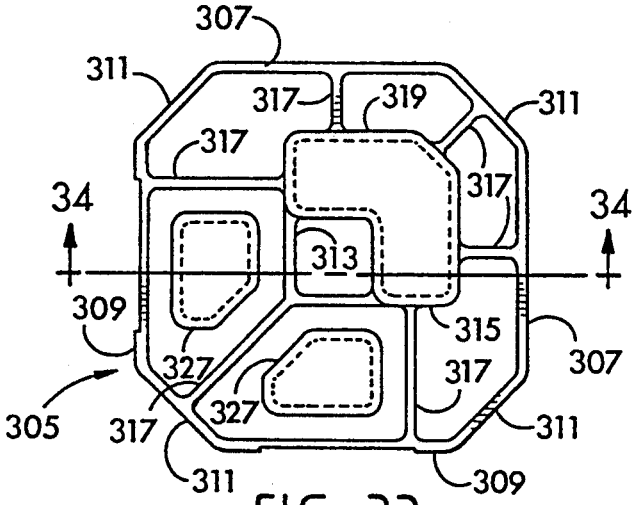
FIG. 33 is a top plan view of the post of FIG. 32.
Figure 35:
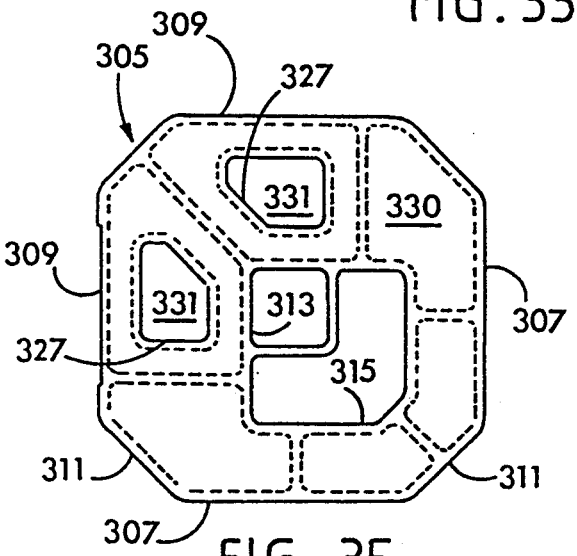
FIG. 35 is a bottom plan view of the post of FIG. 32.
Figure 36:
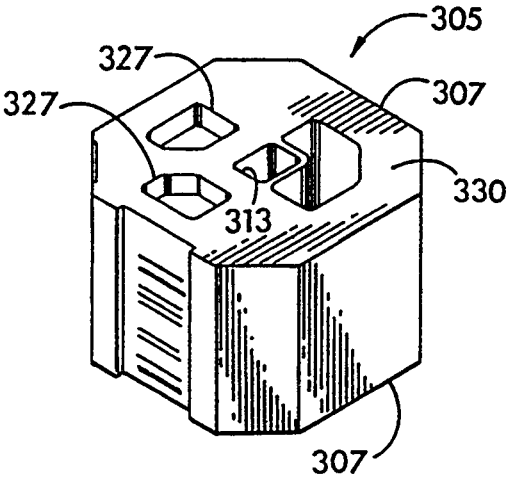
FIG. 36 is a bottom isometric view of the post of FIG. 32.

As shown in FIGS. 32 and 33, the walls 307, 309, 311 of the posts 305 for use with the reinforced bottom deck will preferably be seven-eighths of an inch shorter than the walls of the post 125 for use with an unreinforced bottom deck. The overall height of a pallet 281 will thus be substantially the same as the height of the pallet 120.

Another alternative embodiment of the pallet of the present invention is shown in FIGS. 37–42. The pallet 400 has a twin sheet thermoformed top deck 402 which is spaced above a twin sheet thermoformed plastic bottom deck 404 by nine posts 406 in an orientation similar to that of the pallet 120. The top deck is fastened to the bottom deck through the posts by means of plastic bolts 408 which engage with plastic nuts 410.

Figure 37:
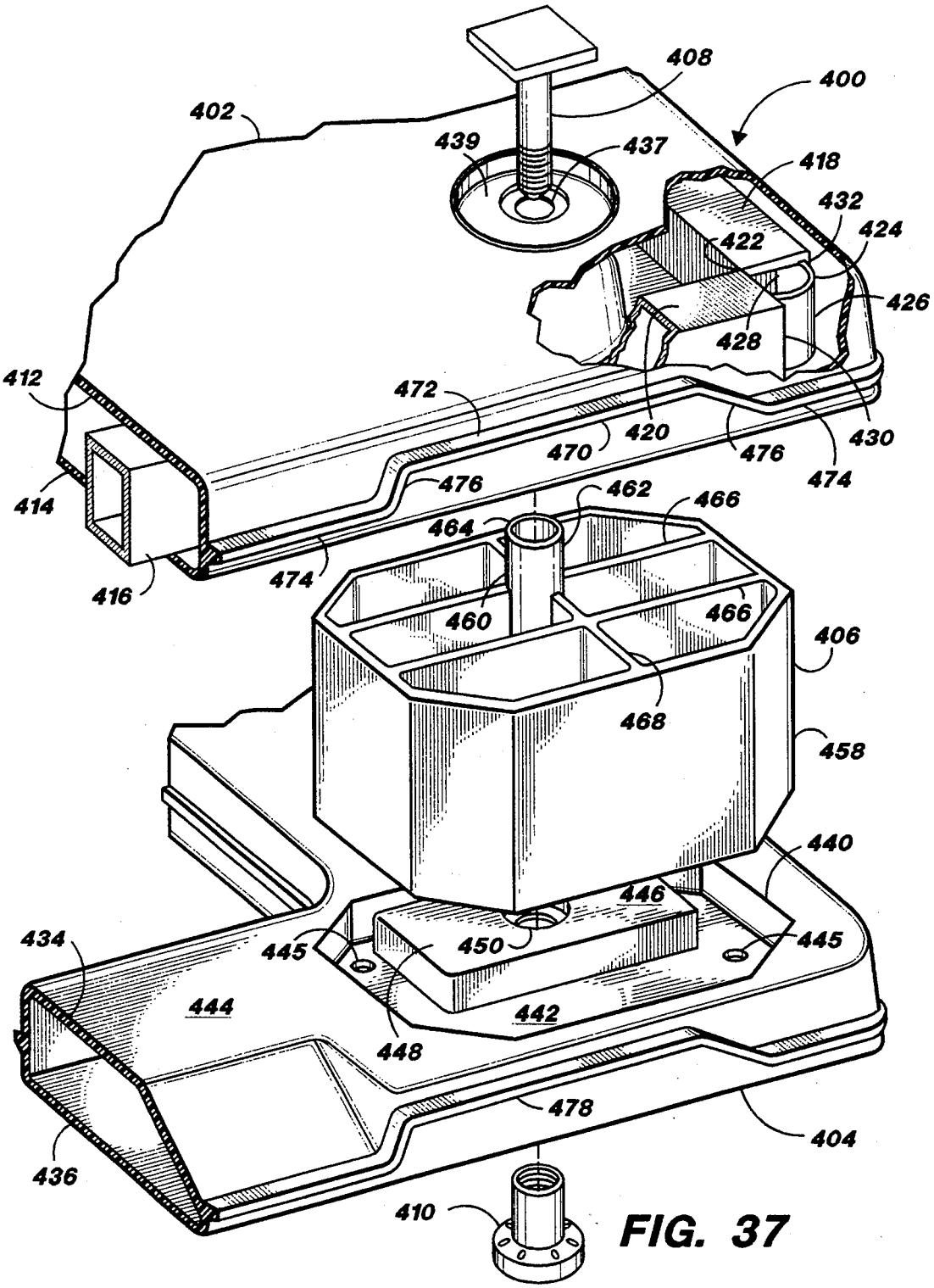
FIG. 37 is a fragmentary exploded isometric view of an alternative embodiment pallet of the present invention.
Figure 38:
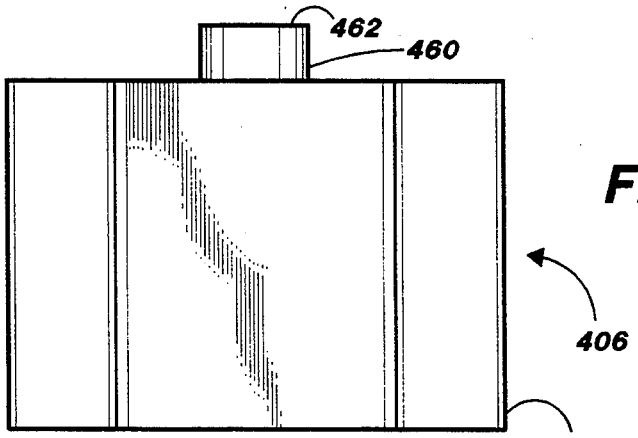
FIG. 38 is a side elevational view of a pallet post of the pallet of FIG. 37.
Figure 39:
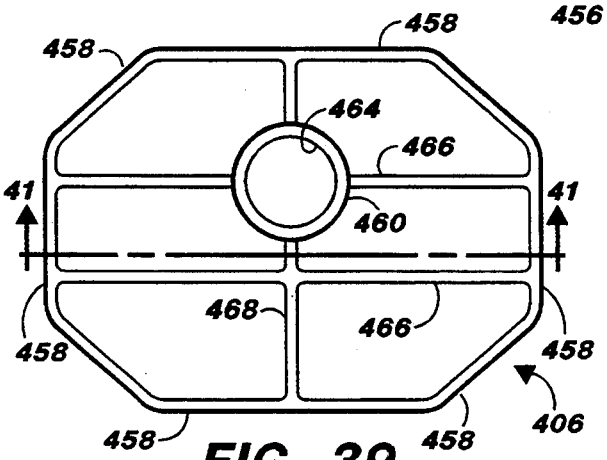
FIG. 39 is a top plan view of the pallet post of FIG. 38.

The top deck is formed in a twin sheet thermoforming process and has a thermoplastic upper sheet 412 which is fused to a thermoplastic lower sheet 414. A metal substrate 416, as shown in FIG. 37, is enclosed between the top deck upper sheet 412 and lower sheet 414. The substrate 416 has a general layout similar to the substrate 36 shown in FIG. 5. However, as an alternative to forming the substrate entirely from bent tubular steel members, the substrate 416 is formed of lateral members 418 which are welded to longitudinal members 420 at an inner vertical joint 422 and which are connected on their exterior side by circular segment bar stock inserts 424. The lateral members 418 are substantially perpendicular to the longitudinal members 420. The exemplary bar stock insert is $\frac{1}{8}'' \times 1''$ tall steel bar and is formed to have a quarter circle radiused segment 426 with a radius of approximately one and three eighths inches and two planar attachment segments 428 which are approximately one half inch long and which extend inside a tubular lateral member 418 and longitudinal member 420 and are welded to the ends of the tubular members at joints 430, 432.

The substrate 416 formed as described above eliminates the need for any tube bending operations and results in a sturdy and economical frame without sharp corners which might pierce the plastic skin of the top deck 402 formed by the upper and lower plastic sheets 412, 414.

Figure 42:
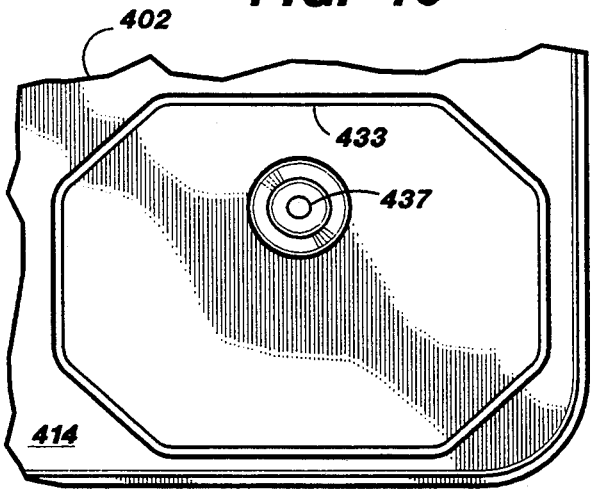
FIG. 42 is a fragmentary bottom plan view of the top deck of the pallet of FIG. 37.

The top deck has a plurality of polygonal ridges 433 which extend downwardly from the top deck lower sheet 414. As shown in FIG. 42, each ridge conforms to the perimeter of a post 406 and assists in locating the post in its proper orientation. A bolt hole 437 is formed at a pinch point within a depression 439 in the top deck through which the bolt 408 extends.

The pallet 400 may be provided with an unreinforced plastic bottom deck 404. The bottom deck 404 is twin sheet thermoformed of a thermoplastic upper sheet 434 which is fused to a thermoplastic lower sheet 436. Pockets 440 are formed in the bottom deck upper sheet 434 and are shaped to receive the posts 406. Each pocket has a recessed floor 442 which is at a level beneath the top surface 444 of the bottom deck 404. A rectangular platform 446 extends upwardly from the pocket floor 442 and has an upper surface 448 which is at approximately the same level as the top surface 444 of the bottom deck. A hole 450 is formed at a pinch point between the upper sheet 434 and lower sheet 436 in the platform 446 within the pocket 440. The floor 442 is formed at a pinch point between the bottom deck upper and lower sheets. Drain holes 445 preferably extend through the floor to allow the escape of any liquid which reaches a pocket 440. The protruding platform 446 is offset inwardly within the pocket 440 and is dimensioned to engage with recessed portions 454 at the base 456 of the post 406.

Each post 406, as shown in FIGS. 38–41 has exterior walls 458 which engage against the top deck lower sheet 414 and bottom deck upper sheet 434 and carry loads from the top deck to the bottom deck. Portions of each post underlie the substrate 416. A cylindrical bolt sleeve 460 is located within the exterior walls 458 and is positioned off center of the post 406. The sleeve 460 has a portion 462 which extends above the exterior walls 458 and which assists in proper positioning of the post 406 with respect to the top deck 402 and bottom deck 404. The sleeve 460 defines a bolt hole 464 through which a bolt 408 extends. The post 406 has two reinforcing webs 466 extending the long direction of the post and a reinforcing web 468 which extends perpendicular to the reinforcing webs 466 and which is interrupted by the sleeve 460.

Figure 40:
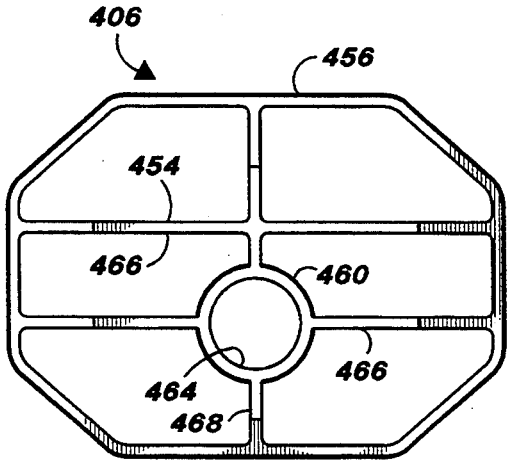
FIG. 40 is a bottom plan view of the pallet post of FIG. 38.
Figure 41:
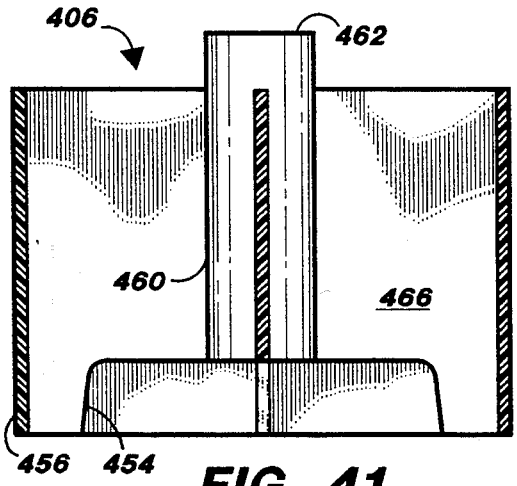
FIG. 41 is a cross-sectional view taken along section line 41—41 of the pallet post of FIG. 39.

As shown in FIGS. 40 and 41, portions of the reinforcing webs 466, 468 and the sleeve 460 define the recessed portions 454 which allow the post base 456 to overlie the protruding platform 446 of the bottom deck pocket 440.

Known twin sheet thermoformed articles have typically been molded by upper and lower thermoforming molds employing two or more register pins which engage with holes in an opposing mold. Register between the upper and lower thermoforming molds is essential for accurate part formation and insures that pinch points occur at properly mated upper and lower sheets to allow fusion to take place. Register pins, however, require that the thermoforming molds include portions which extend outwardly from the perimeter of the molded part and hence require added mold material and cost. Furthermore, register pins insure proper alignment primarily at discrete points around the perimeter.

As shown in FIG. 37, the pallet 400 has a parting line 470 which is the result of the mating of the upper sheet mold and the lower sheet mold. After the molding step excess plastic which extends along the parting line is typically trimmed off with a router or saw.

The parting line 470 has alternating upper portions 472 and lower portions 474 which are joined by inclined portions 476 which extend at an angle of approximately 45 degrees between the upper and lower portions. In an exemplary part, such as the top deck 402, the upper portions and lower portions 472, 474 may be approximately 4½" wide and the inclined portions 476 may be approximately ¾" wide. The inclined portions 476 are formed by similarly inclined portions of the thermoforming molds which serve as cam surfaces to move the two molds and the thermoplastic sheets therebetween into proper alignment. As the molds are brought closer together, the inclined portions of the molds force the sheets into proper registry.

The bottom deck 404 has a similar parting line 478.

An alternative pallet 480 having a metal substrate reinforced bottom deck 482 is shown in FIGS. 43–46. The reinforced bottom deck pallet 480 has a top deck 402 which is identical to that of the pallet 400. The thermoforming molds for the unreinforced bottom deck 404 may preferably be constructed with a replaceable mold insert which forms the pockets 440 which define the structure for engaging with the pallet post. The replaceable mold insert may then be removed and an alternative mold insert positioned in the upper thermoforming mold which forms four blind slots 484, 486 in the pallet bottom deck 482 upper thermoplastic sheet 488. The slots are depressions which terminate in pinch points and are located beneath plastic posts 490 which are similar to the post 406 but include four plastic tabs 492, 494. The tabs 492, 494 extend downwardly from the post 490 sidewalls 496 and engage within the slots 484, 486.

Figure 43:
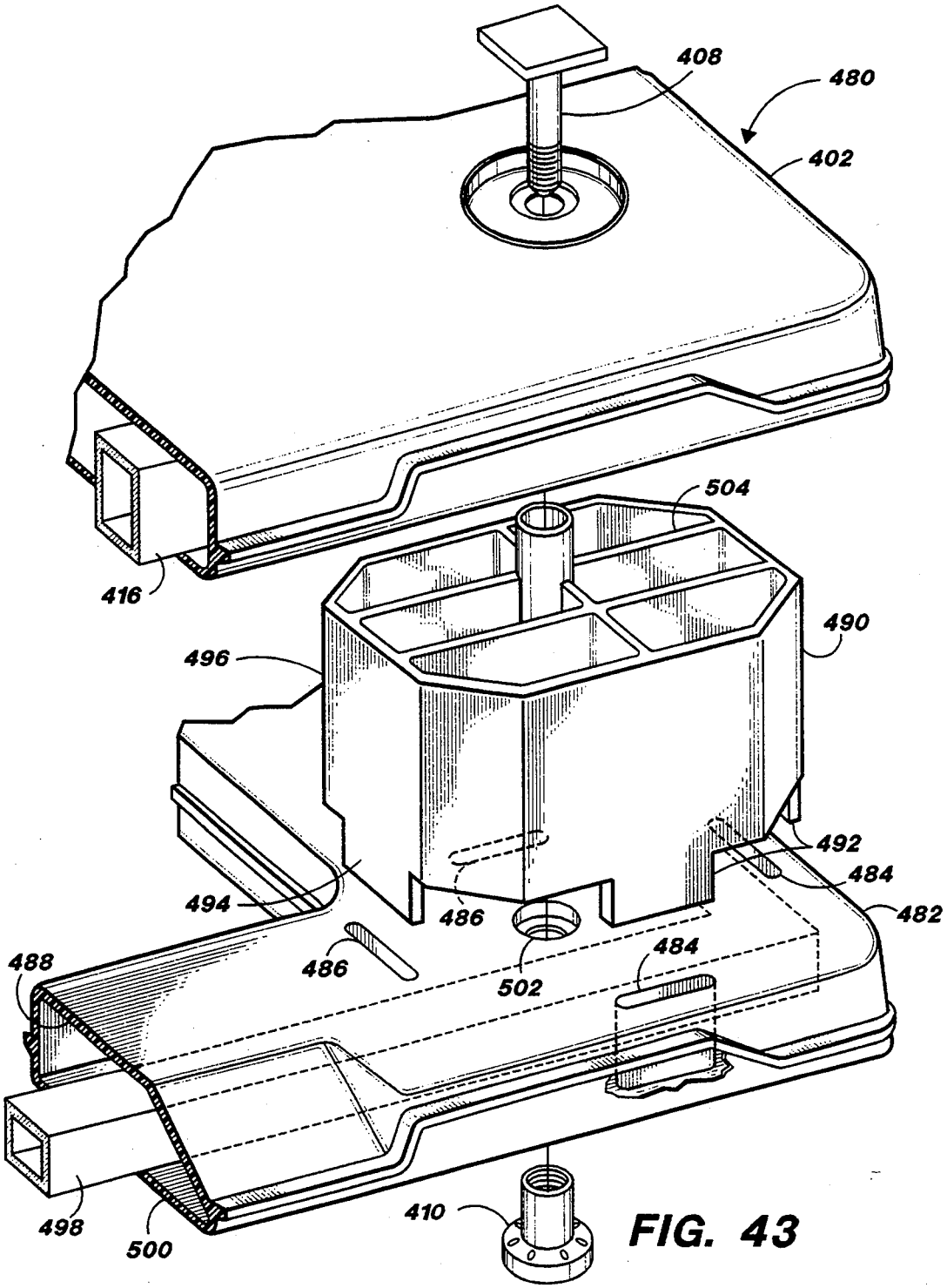
FIG. 43 is a fragmentary exploded isometric view of a reinforced bottom deck which may be employed with the pallet of FIG. 37.
Figure 44:
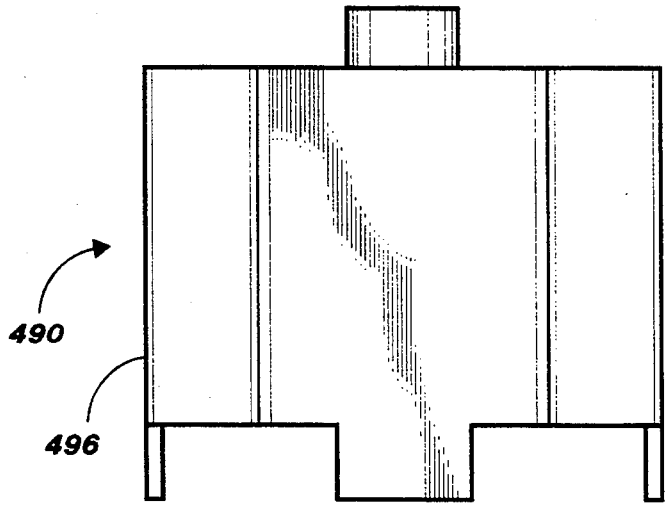
FIG. 44 is a side elevational view of the pallet post of FIG. 43.
Figure 45:
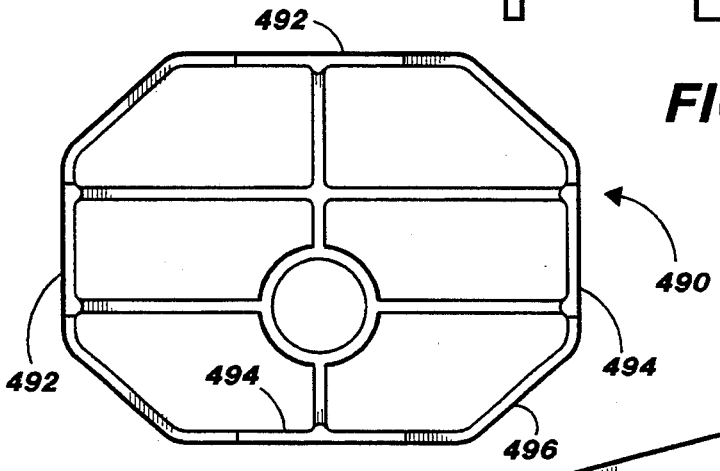
FIG. 45 is a bottom plan view of the post of FIG. 44.
Figure 46:
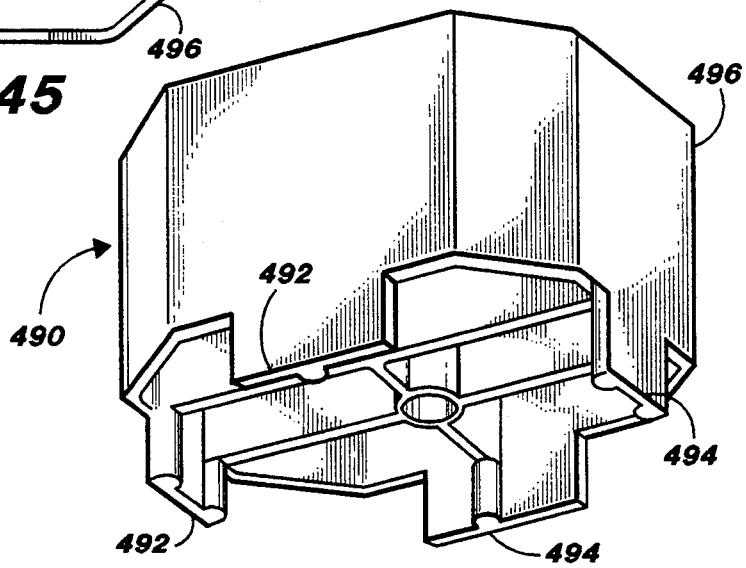
FIG. 46 is a bottom isometric view of the post of FIG. 4—4.

A tubular metal substrate 498, shown in FIG. 43, is enclosed between the upper sheet 488 and the lower sheet 500 of the bottom deck 482. The substrate 498 extends between the outer slots 484 and the nut depression 502 of the bottom deck 482 and is thus positioned beneath the web 504 and portions of the sidewalls 496 of the post 490.

Pallets may be formed according to this invention with the capacity to accommodate various levels of load at optimum cost. Heavy loads, for example, may be accommodated with a reinforced top deck 402 and a reinforced bottom deck 482. Less demanding loads may be accommodated with a pallet having a reinforced top deck 402 and an unreinforced bottom deck 404. The least demanding loads may be supported on a pallet having an unreinforced bottom deck and top deck similar to the deck 402 but without any reinforcing substrate. The unreinforced top deck may be further stiffened for optimum performance without metal substrate by providing additional pinch points between the upper and lower top deck sheets.

It should be noted that where plastic bolts and nuts have been shown, metal fasteners may also be employed. Metal fasteners may be desirable in pallets to be used in low temperature environments where plastic fasteners may become undesirably brittle.

Although the pallets 120, 281, 400, 480 have been illustrated with nine posts, a greater or lesser number of posts may be employed depending upon the requirements of a particular application. In addition, although octagonal posts have been shown, polygonal posts having more or fewer sides may be employed. Furthermore, the rib structure formed on the lower sheets of the top and bottom decks may be replaced by equivalent designs of varying appearance. It should also be noted that while the corners of the tubular metal substrate have been shown as radiused, angular welded corners may also be employed. Also, the interior framework of the metal substrate may be modified to suit particular applications and stress concentrations.

It is important to note that the present invention is not limited to the particular construction and arrangement of parts disclosed and illustrated herein, but embraces all modified forms thereof as come within the scope of the following claims.

We claim:

1. A pallet comprising:

a) a sealed twin-sheet thermoformed top deck having an upper thermoplastic sheet and a lower thermoplastic sheet wherein portions of the lower thermoplastic sheet are fused to the upper sheet at a plurality of pinch points, and a plurality of bolt holes are formed at top deck pinch points;

b) a metal reinforcing substrate located between the top deck upper sheet and lower sheet, wherein the fused portions are spaced from the substrate;

c) a sealed twin-sheet thermoformed bottom deck having an upper thermoplastic sheet fused to a lower thermoplastic sheet at a plurality of pinch points, wherein portions of the pinch points define bolt holes extending through the bottom deck;

d) a plurality of plastic posts extending between the top deck and the bottom deck, wherein each post has portions which underlie the metal reinforcing substrate; and e) fasteners which extend through the posts and through the bolt holes in the top deck and the bottom deck to connect the top deck to the bottom deck.

2. The pallet of claim 1 wherein the sheets of at least one deck are fused to one another at a parting line, and wherein the parting line has at least one upper portion and one lower portion which are joined by an inclined portion which extends at an angle between the upper and lower portions, said parting line inclined portion being formed by similarly inclined portions of upper and lower thermoforming molds which serve as cam surfaces to move the two molds and the thermoplastic sheets therebetween into proper alignment in the molding process.

3. The pallet of claim 1 wherein the posts are polygonal, and further comprising a polygonal ridge which extends downwardly from the top deck upper sheet to encircle the polygonal post where it engages the top deck lower sheet.

4. The pallet of claim 1 wherein the top deck metal substrate comprises:

a) at least one tubular lateral member;

b) at least one tubular longitudinal member which is welded to the lateral member and which is substantially perpendicular to the lateral member;

c) a curved bar stock insert which extends within the lateral member and the longitudinal member and which is welded to the tubular members, wherein the substrate is resistant to puncturing of the top deck plastic sheets.

5. The pallet of claim 1 further comprising at least one drain hole defined by portions of a bottom deck pinch point to facilitate the escape of liquid from the pallet bottom deck.

6. The pallet of claim 1 further comprising:

a reinforcing metal substrate between the pallet bottom deck upper sheet and lower sheet;

b) at least one slot formed by a depression in the pallet bottom deck upper sheet above a pinch point; and c) at least one tab which extends downwardly from a post into engagement with the bottom deck slot, wherein the post has portions which overlie the substrate within the bottom deck.

7. A pallet comprising:

a) a twin sheet thermoformed top deck;

b) a twin sheet thermoformed bottom deck having an upper thermoplastic sheet and a lower thermoplastic sheet fused to the upper thermoplastic sheet at a plurality of pinch points, wherein portions of the pinch points define bolt holes extending through the bottom deck; and c) a reinforcing metal substrate located between the bottom deck upper sheet and lower sheet and sealed therein;

d) a plurality of plastic posts which extend between the top deck and the bottom deck, wherein each post has a base which engages with the bottom deck upper sheet at a location which overlies the metal substrate, and wherein each post has at least one protrusion which extends downwardly and engages within a depression in the bottom deck spaced from the substrate, the depression located above a pinch point; and e) a fastener which extends through each post to connect the upper deck to the bottom deck.

8. A pallet comprising:

a) a sealed twin-sheet thermoformed top deck having an upper thermoplastic sheet and a lower thermoplastic sheet fused to the upper sheet at a plurality of pinch points;

b) a plurality of bolt holes extending through the top deck upper sheet and lower sheet;

c) a sealed twin-sheet thermoformed bottom deck spaced beneath the top deck and having an upper thermoplastic sheet and a lower thermoplastic sheet fused to the upper sheet at a plurality of pinch points;

d) a plurality of bolt holes extending through the bottom deck upper sheet and lower sheet, each bottom deck bolt hole being aligned with a top deck bolt hole;

e) a plurality of plastic posts extending between the top deck and the bottom deck, wherein each post has a support member engaged against the lower sheet of the top deck in load-beating relation and a sleeve portion is integrally formed with the support member, wherein the sleeve portion extends upwardly within the top deck and has portions defining a bolt hole which is aligned with a top deck bolt hole and a bottom deck bolt hole, and wherein the sleeve portion is offset from the center of the post, such that the sleeve portion aligns the post for a desired orientation with respect to the top and bottom decks; and a plurality of fasteners, wherein each fastener extends through a top deck bolt hole, a bottom deck bolt hole, and a post bolt hole to connect the upper and lower decks.

* * * * *